US008096310B2

(12) United States Patent
Clarke

(10) Patent No.: US 8,096,310 B2
(45) Date of Patent: Jan. 17, 2012

(54) UMBRELLA ASSEMBLY STRUCTURED FOR USE IN HIGH WIND CONDITIONS

(75) Inventor: Dougan H. Clarke, Miami Beach, FL (US)

(73) Assignee: TUUCI Worldwide, LLC., Miami, FL (US)

( * ) Notice: Subject to any disclaimer, the term of this patent is extended or adjusted under 35 U.S.C. 154(b) by 0 days.

(21) Appl. No.: 11/479,989

(22) Filed: Jun. 30, 2006

(65) Prior Publication Data

US 2007/0062565 A1 Mar. 22, 2007

Related U.S. Application Data

(63) Continuation-in-part of application No. 10/779,465, filed on Feb. 13, 2004, now abandoned.

(60) Provisional application No. 60/447,122, filed on Feb. 13, 2003.

(51) Int. Cl.

| | |
|---|---|
| ***A45B 25/02*** | (2006.01) |
| ***A45B 25/22*** | (2006.01) |
| ***A45B 15/00*** | (2006.01) |

(52) U.S. Cl. ..... 135/16; 135/88.01; 135/27; 135/33.41

(58) Field of Classification Search ..... 135/88.01, 135/16, 27, 31, 33.2, 33.4, 33.41, 88.05, 135/88.13

See application file for complete search history.

(56) References Cited

U.S. PATENT DOCUMENTS

| | | | | | |
|---|---|---|---|---|---|
| 579,185 | A | * | 3/1897 | Shaine | 135/25.1 |
| 1,167,431 | A | * | 1/1916 | Raabe | 135/27 |
| 2,319,118 | A | * | 5/1943 | Farkas et. al. | 135/31 |
| 4,086,931 | A | * | 5/1978 | Hall | 135/98 |
| 4,407,317 | A | * | 10/1983 | Crandall | 135/27 |
| 5,226,438 | A | * | 7/1993 | Dubinsky | 135/33.4 |
| 5,354,031 | A | * | 10/1994 | Bilotti | 248/519 |
| 5,441,066 | A | * | 8/1995 | Harris | 135/88.01 |

* cited by examiner

*Primary Examiner* — David Dunn
*Assistant Examiner* — Danielle Jackson
(74) *Attorney, Agent, or Firm* — Malloy & Malloy, P.A.

(57) ABSTRACT

An umbrella frame structured for use in a strong wind conditions such as those conditions frequently encountered on a boat traveling at relatively high speeds. An umbrella frame assembly includes a reinforcing assembly connected thereto in a supportive, operative orientation thereby providing a stable support for an umbrella canopy which can remain open even during travel of the boat. The frame assembly can be modified to support canopies of varying shapes and sizes and the frame assembly can be easily removed, for storage purposes, from a supporting base which may be mounted on or connected to a boat.

14 Claims, 16 Drawing Sheets

UMBRELLA ASSEMBLY STRUCTURED FOR USE IN HIGH WIND CONDITIONS

CLAIM OF PRIORITY

The present application is a continuation-in-part application of and a claim of priority is made to a patent application having Ser. No. 10/779,465, now abandoned filed on Feb. 13, 2004, which claims priority to then patent application Ser. No. 60/447,122 filed on Feb. 13, 2003, under 35 U.S.C. Section 119(e), with each of the above noted patent applications being incorporated herein by reference in their entireties.

BACKGROUND OF THE INVENTION

1. Field of the Invention

This invention relates to an umbrella assembly structured for use in a strong wind environment such as, but not limited to, the conditions frequently encountered on a moving boat or like marine craft. The umbrella assembly comprises a frame assembly and a canopy and is structured to assume an outwardly extending, substantially flat configuration, which ideally, is also structured for selective positioning in a substantially conventional open orientation as well as in at least a closed orientation. In some embodiments, the umbrella assembly may include a reinforcing assembly structured to provide increased structural integrity sufficient to resist wind forces to which the umbrella assembly may be subjected, such as during use on a marine craft capable of traveling at relatively high speeds. In other embodiments, the umbrella assembly may also include an anchor assembly structured to secure predetermined portions of the canopy to predetermined portions of the frame assembly.

2. Description of the Related Art

Boats and/or other marine craft are structured in general for travel on bodies of water where there are no trees or other natural structures to provide shade. Due to the heat and other harsh effects of the sun, however, there is a clear and frequent need to provide some shade on a boat so as to offer its occupants some protection and relief. As such, larger boats whether sailboats, cruisers and other power boats, yachts, etc. are typically formed to have one or more cabins or other interior areas. Smaller pleasure boats, on the other hand, must often rely on lightweight and sometimes foldable shade structures, sometimes referred to as "bimini tops," which are typically somewhat flimsy and which can be difficult to maneuver.

For example, many smaller power boats suitable for water skiing and cruising are provided with a main seating area protected by a windshield typically located on a forward portion or mid-section thereof. In addition, these types of boats often include a foldable shade structure having a plurality of movable poles that are removably connected to opposite sides of the boat, near the windshield's outer edges. The poles normally span the width of the boat and include a fabric canopy or like structure attached thereto to provide shade. While this type of shade structure may be generally functional, it is not readily adaptable for use on a significant number of boats such as, but not limited to a marine craft known as an "open fisherman." This is at least partially due to the fact that placement of the poles would interfere with movement of the boat's occupants while fishing, or other situations requiring a need to travel freely about the periphery of the boat. In order to overcome problems of this type, boats known as "open fishermen" and similarly designed marine craft typically include a centrally located steering and/or console area with a pair of closely spaced, fixed and rigid upstanding posts. A fixed awning or canopy structure is attached to and spans the distance between the posts' upper ends to provide some shade, usually around the console area. This type of structure allows for a clear path of travel about the boat's periphery including along the port and starboard sides.

While these types of fixed shade structures are quite common and accepted, there are obvious and long recognized disadvantages or inconveniences associated with them. For instance, there are times when it is desirable to not have any shade structure in place, such as when the boat is in shallow waters for fishing of certain types of fish, so as to allow for better maneuverability and/or visibility. Of course, those situations may be temporary or relatively short in duration, particularly if the day is hot and sunny, such that it would soon become desirable to have some shade readily available. As another example, because most, if not all of the known shade structures are fixed, as set forth above, there is no practical way to adjust the amount and or position of available shade created by these structures. Therefore, there is little one can do to protect against the sun's rays coming from various angles as the sun passes overhead and/or at various times of day. Also, it can be difficult to clean the awning and/or canopy on these types of rigid shade structures. These and other inconveniences associated with conventional shade structures used on the "open fisherman" type of boats, have the ability to and frequently do lessen the enjoyment one would normally expect while using such watercraft.

With regard to a totally distinct field of art, namely, that relating to umbrellas, it is known to use large, upstanding, outdoor umbrellas at restaurants, bars, hotels, and other places that offer outdoor seating so as to shield people from the sun, as well as from other elements of nature, such as wind, light rain, etc. While these types of outdoor umbrellas are designed to endure many relatively harsh outdoor conditions, they are typically not structured to overcome more extreme conditions including, but not limited to substantially constant and/or strong wind conditions frequently associated with open bodies of water. Also, many umbrellas known in the art do not allow for any adjustment in terms of increasing or decreasing the amount of shade being cast by the canopy of the umbrella.

It is believed by the inventor herein that there has never been a successful effort to develop a shade structure capable of being used on boats or other marine craft which has the efficiency, operational versatility and convenience offered by umbrellas. Of course, if any such improved shade structure were provided for use on boats, the high wind and other conditions unique to boating would have to be addressed. Such conditions should also include anchoring and support requirements sufficient to withstand the rocking motion and/or other movement of the boat as well as prolonged exposure to the sun's rays. Other features associated with any such improved shade structure should preferably include ease of positioning into and out of an operable and/or stored orientation, whenever desired, whether for certain fishing conditions, cleaning, repair, etc. Further, any such improved shade structure especially, but not exclusively, of the type capable of being used on an "open fisherman" type of boat, should be structured to permit free travel about the periphery of the boat. Finally, any such improved shade structure should also be ideally capable of at least some adjustment to provide shade against the sun's rays at various times of the day.

SUMMARY OF THE INVENTION

The present invention is intended to present a solution to the problems in this field of art, and as such, relates to an umbrella assembly structured for use under strong wind conditions of the type frequently, but not exclusively, encountered on boats or other marine craft. More in particular, the present invention comprises a frame assembly capable of being mounted or connected to a marine craft and/or be a part of the marine craft, and which is structured to assume an outwardly extending, substantially flat configuration.

In addition, the frame assembly includes, in one or more preferred embodiments, a plurality of ribs disposed and structured to support a canopy thereon, and a plurality of struts. Most preferably, the plurality of struts are movably connected to a support pole by a hub assembly and also to the plurality of ribs, with the plurality of ribs and struts as well as the hub assembly being collectively structured to allow selective orientation of the frame assembly, as well as the shade producing canopy supported thereon, between an open, outwardly extended, operative position and a closed, substantially collapsed position.

As set forth above, a primary object of the umbrella assembly of the present invention is to be effectively operable under conditions such as, but not limited to, strong wind that may be continuously encountered on a marine craft, whether or not the marine craft is traveling, even at relatively high speeds. Accordingly, the preferred embodiments of the umbrella assembly of the present invention further comprise a reinforcing assembly connected to predetermined portions of the frame. The reinforcing assembly is preferably disposed in supporting relation to at least some of the plurality of rib and strut pairs, wherein each rib and strut pair comprises correspondingly disposed ones of the plurality of ribs and struts. Moreover, the reinforcing assembly includes at least one, but more practically, a plurality of auxiliary struts. Each of the auxiliary struts are strategically disposed and structured to significantly increase the structural integrity of the frame assembly specifically and the umbrella assembly generally. The umbrella assembly is thereby sufficiently reinforced to withstand the high wind conditions in a boating or marine craft environment, as well as in a variety of other environments which may encounter strong winds or other extreme conditions.

Yet another preferred embodiment of the present invention incorporates an anchoring assembly which is preferably used in combination with the reinforcing assembly, as described above, but may also be used independently thereof. More specifically, the anchor assembly is disposed and structured to secure predetermined portions of the canopy to predetermined portions of the frame, such as, but not limited to, the leading portions and the trailing portions of the frame. While the structural modifications of the anchor assembly may vary, one preferred embodiment comprises the anchor assembly including a plurality of anchor members fixedly secured to the canopy, such as at or along inner surface portions thereof. Each of the anchor members are structured to engage and secure the canopy to an intermediate portion of predetermined ones of the rib and strut pairs by engaging and at least partially surrounding an intermediate length of the rib associated with each of the predetermined rib and strut pairs. As such, operative orientation of the anchor assembly serves to maintain the canopy in its secured and supported position on the ribs, while the umbrella assembly is opened and encounters high wind conditions, such as when the marine craft is traveling.

As set forth above the reinforcing assembly, including one or more auxiliary struts may be used in combination with the anchoring assembly. Moreover, when combined, one embodiment of the umbrella assembly of the present invention includes the reinforcing assembly and the anchoring assembly being "commonly connected" to one or more, predetermined rib and strut pairs. As also set forth above, it is recognized that high wind conditions may best be addressed by commonly connecting the anchoring assembly and the reinforcing assembly to one or more rib and strut pairs associated with the leading portion of the frame assembly, as well as one or more rib and strut pairs associated with the trailing portion of the frame assembly. As will be explained in greater detail hereinafter with specific reference to the accompanying figures, the leading and trailing portions of the frame assembly is/are meant to refer to those portions of the frame assembly generally aligned or most closely associated with the front and rear portions, respectively, of the marine craft on which the umbrella assembly of the present invention is used. Accordingly, the direction of travel of the marine craft at any given time is not used herein as a determination of the leading or trailing portion of the frame assembly.

While at least one embodiment of the umbrella assembly is shown and illustrated herein, it is emphasized that the dimension and configuration of the frame assembly, accompanying canopy, as well as the various structural and operational components associated therewith, may vary greatly dependent, at least in part, on the dimension, configuration, style, as well as other physical characteristics of the marine craft on which it is mounted. By way of example only, at least one embodiment of the umbrella assembly of the present invention is structurally adaptable for use on an "open fisherman" type of boat, wherein the efficient creation of shade, as well as the freedom of movement of the occupants about the boat are significant considerations. However, it is emphasized that the umbrella assembly of the present invention is not intended to be limited for use on an "open fisherman" type of marine craft. To the contrary, with little or no structural modification other than variations in the dimension or configuration, various embodiments of the umbrella assembly of the present invention can be used on any of a variety of marine craft or on land where strong winds and other relatively extreme environmental conditions may be encountered.

Increased versatility of the various embodiments of the umbrella assembly of the present invention is further demonstrated by the provision of a canopy having a variety of different sizes and shapes. Also, the canopy may be supported by the frame assembly in a selectively movable and adjustable manner. The latter feature facilitates the creation of an adequate amount of shade for a variety of different boating or other environments. Moreover, structural and operative features of the umbrella assembly facilitate the ability to adjust the shaded area on or about a marine craft depending upon the orientation of the craft itself, as well as the position of the sun in the sky.

BRIEF DESCRIPTION OF THE DRAWINGS

For a fuller understanding of the nature of the present invention, reference should be had to the following detailed description taken in connection with the accompanying drawings in which:

FIG. 1-A is a perspective view in partial cutaway of a preferred embodiment of the umbrella assembly of the present mounted on a marine craft.

Like reference numerals refer to like parts throughout the several views of the drawings.

DETAILED DESCRIPTION OF THE PREFERRED EMBODIMENTS

Figure 1:
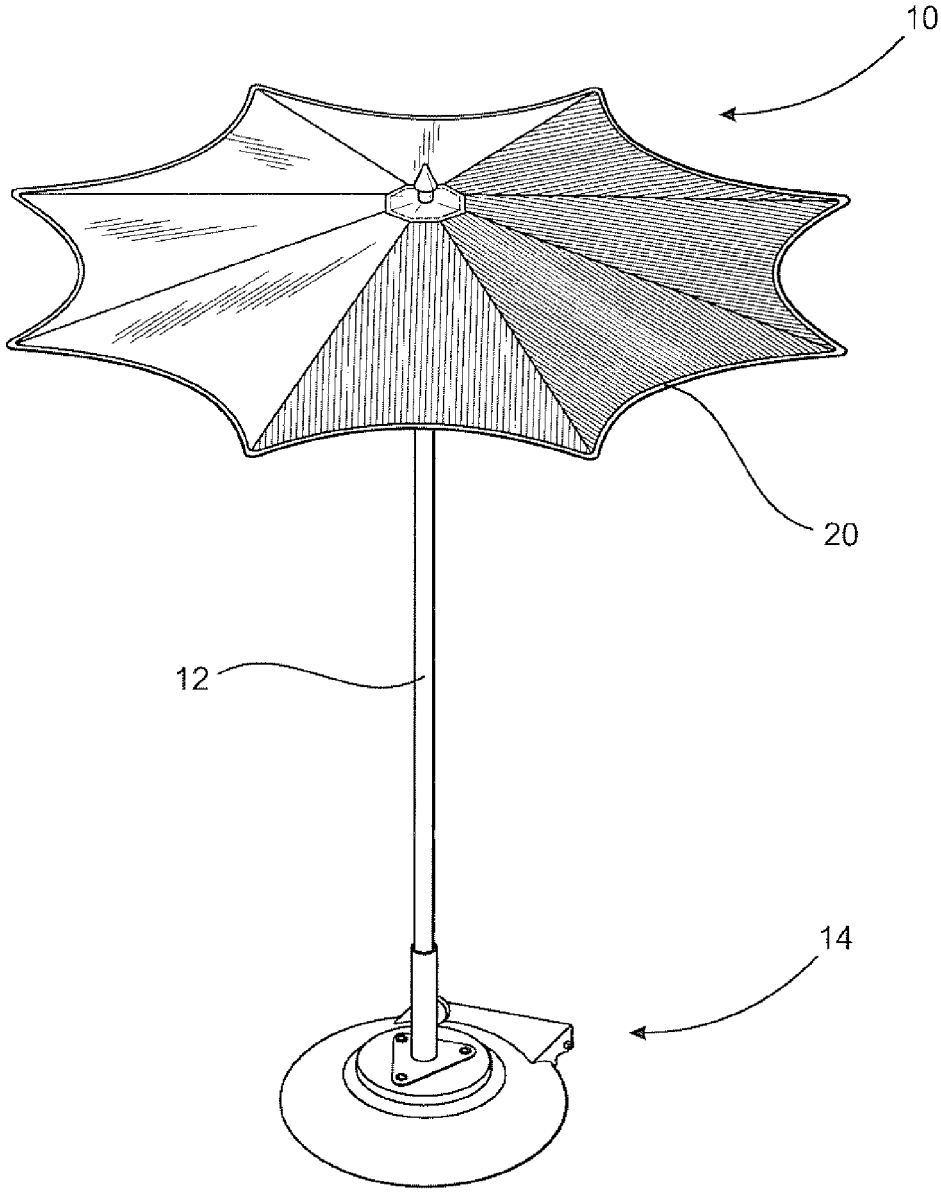
FIG. 1 is a perspective view of one possible embodiment of an umbrella assembly of the present invention.

The present invention is directed to an umbrella assembly, wherein one preferred embodiment is generally indicated as 10 and comprises a frame assembly represented in detail in FIGS. 1 through 8 of the accompanying drawings. As will be more fully explained, the frame assembly and the various operative components associated therewith are specifically structured to support an umbrella canopy 20 and facilitate its opening and closing. As such, it should be understood at the outset that the present invention is susceptible of embodiment in different forms, and even though there is shown in the drawings and will be described in detail herein at least one specific embodiment, the present disclosure is to be considered as an exemplification of the principles of the invention and is not intended to limit the invention to the embodiment or embodiments illustrated Accordingly, and with initial reference to FIGS. 1-2, the umbrella assembly 10 includes an elongated support pole 12 which is normally, but not exclusively, operatively disposed in a substantially upright and/or vertical orientation when the frame assembly is an open position as demonstrated in FIGS. 1, 1-A and partially in FIG. 2. The lower end of the support pole 12 is secured to a base generally indicated as 14, 14' in FIGS. 1 and 1A. The base 14, 14' may assume any of a variety of different structures and/or configurations capable of supporting the pole 12 and the remainder of the frame assembly in a stable manner, especially when in an operative position as demonstrated.

Figure 1A:
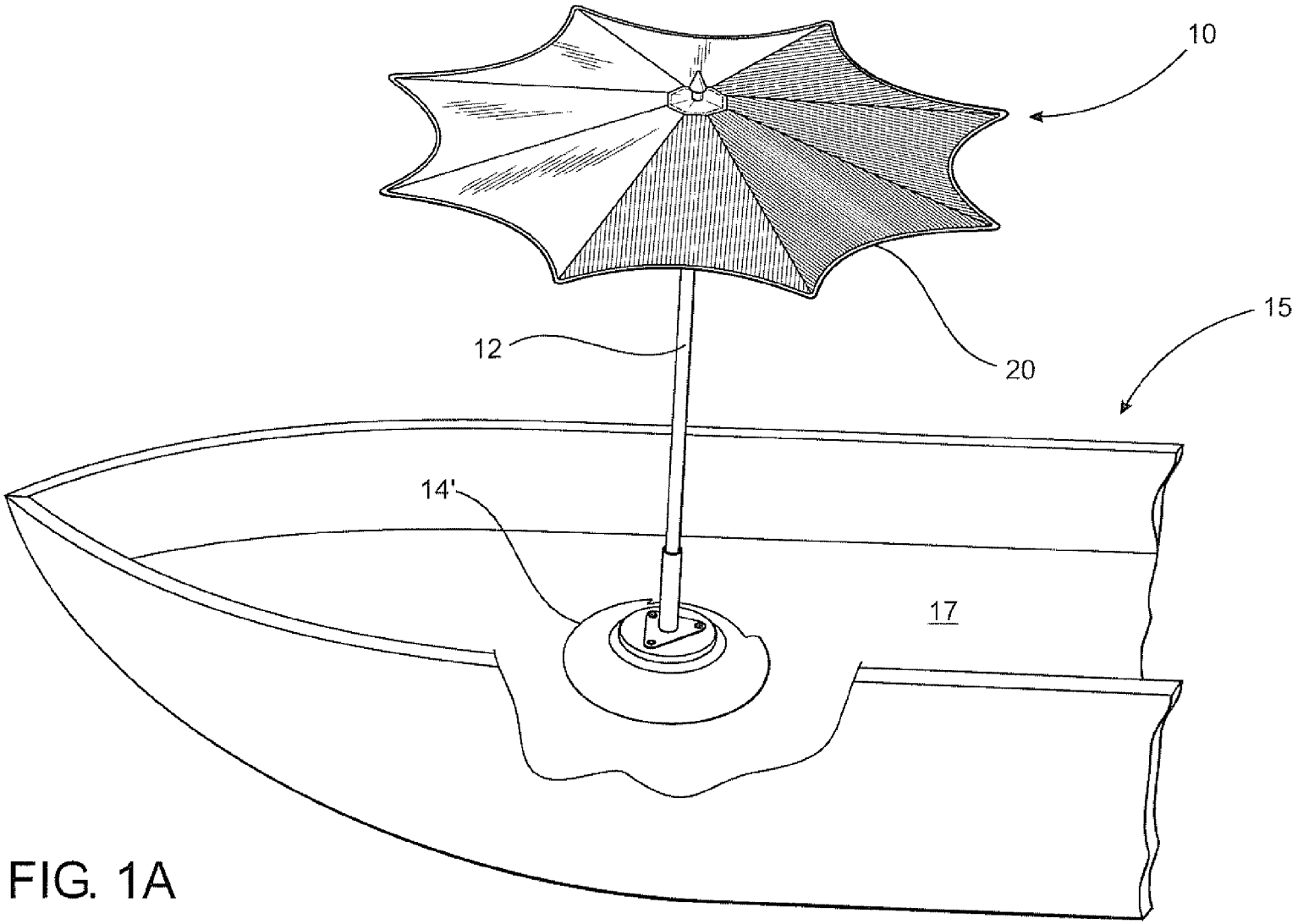

As shown in FIG. 1A, to be described in greater detail hereinafter, the base 14' is structured to be mounted on or attached to the deck 17 or hull of a marine craft 15 so as to facilitate the mounting, operation and use of the umbrella assembly 10 on the craft 15, even when the craft is traveling at relatively high speeds. Also, a preferred embodiment of the base 14, 14' is structured to removably support the pole 12, thereby allowing the frame assembly to be removed therefrom, such as when the umbrella assembly 10 is intended to be stored or removed for cleaning, repair, etc. Moreover, the base 14, 14' may assume a variety of different structures, dimensions and configurations, any one of which may be adapted to be mounted on or connected to a predetermined portion of the boat 15, dependent on the intended application of the umbrella assembly 10. The specific structural features of the base, 14 or 14' will vary dependent on the intended location of the umbrella assembly 10 on the boat 13 and also on the type of boat or marine craft on which the umbrella assembly 10 is intended to be used.

Also, as will be described hereinafter with regard to the additional preferred embodiment represented in FIG. 14, the supporting base may be at least partially defined by a structural portion of the marine craft itself, rather than or in addition to a separate base 14, 14' as generally represented in FIGS. 1 and 1A.

Figure 14:
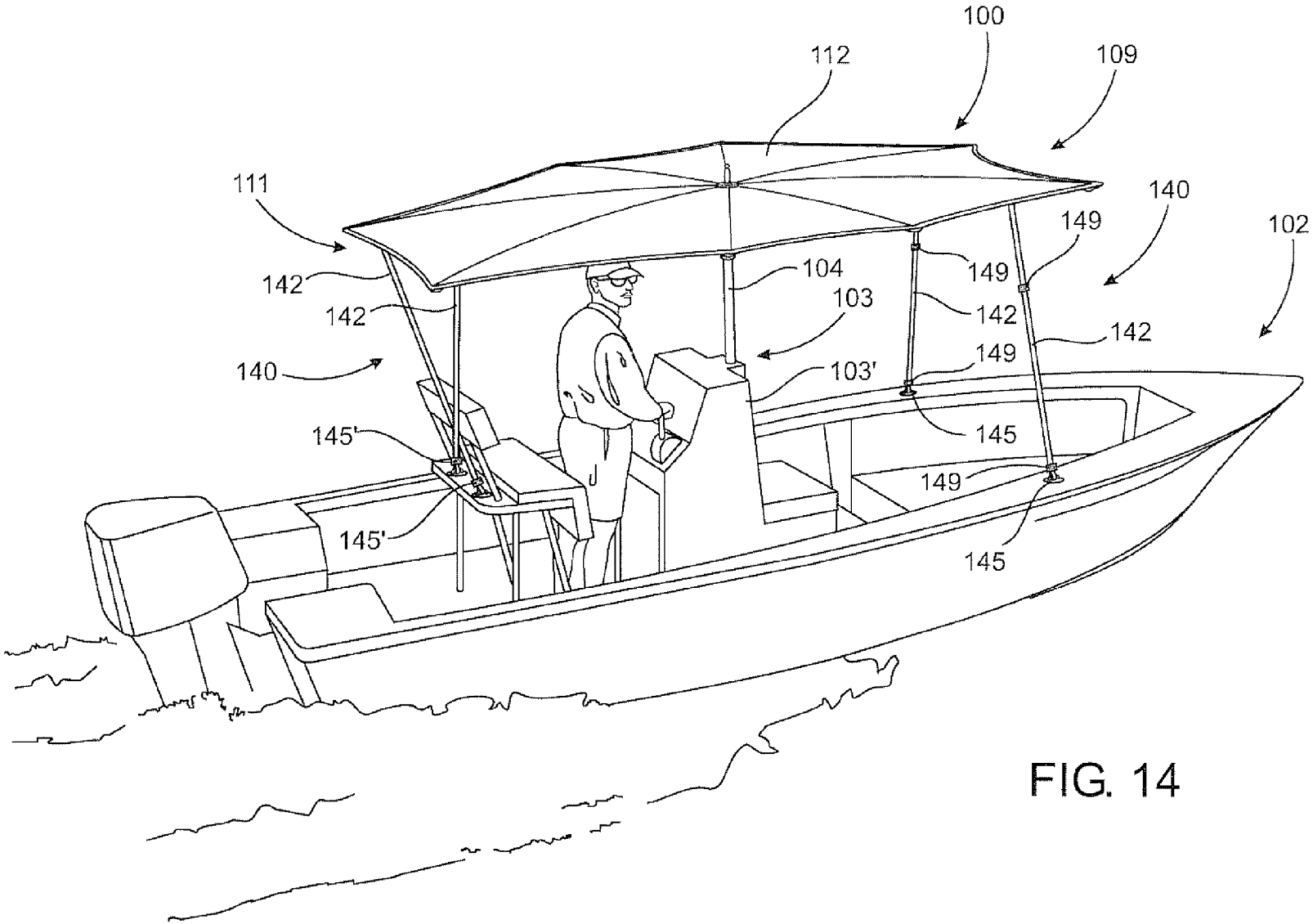
FIG. 14 is a perspective view of the umbrella assembly of the present invention in a more preferred embodiment.

While the plurality of preferred embodiments of the present invention are not specifically limited for use on a particular type of boat, the embodiments of the umbrella assembly 10 and 100 as represented in FIGS. 1A and 14 respectively, are especially well suited for use on a type of boat commonly known as an "open-fisherman." This type of boat is typically provided with a centrally located steering or console area, such as 103 in FIG. 14, about which the occupants of boat are free to move so as to perform various activities including, but not limited to, fishing. Therefore, and by way of example, the structure, configuration and disposition of the preferred embodiments of the umbrella assembly 10 and 100, as perhaps best demonstrated in FIG. 14, will provide a significant amount of shade to the deck area of the boat, as well as the occupants thereon. Moreover, the size, configuration and location of either of the umbrella assemblies 10 and 100 will not interfere with the freedom of movement of an appropriate number of occupants about the respective marine crafts.

With primary reference to FIGS. 1 through 13, the umbrella assembly 10 may be easily and quickly removed from the base 14, 14' so as to facilitate storage of the umbrella assembly 10, such as when one or more occupants of the boat require total freedom of movement, an unobstructed view and/or when the generation of shade is no longer a consideration. Also, it is emphasized that the boat or marine craft 15, at least partially disclosed in FIG. 1A, is intended to be generically representative of various types of marine craft including, but not limited to, the aforementioned "open fisherman" on which the umbrella assembly 10 may be mounted and used. Naturally, the location, size and configuration of the umbrella assembly 10 may vary greatly, as at least partially demonstrated in FIGS. 10 through 13, dependent on the type, size, etc. of the marine craft.

The umbrella assembly 10 comprises in one embodiment a frame assembly disclosed in detail in FIGS. 2 through 8. Many of the operative components of the frame assembly are disclosed in these drawings and are also described in detail in U.S. Pat. No. 6,889,699 which issued on May 10, 2005, in the name of the inventor hereof. Additional features of the umbrella assembly 10 of the present invention are disclosed in another patent, namely, U.S. Design Pat. No. D478,416 which issued on Aug. 19, 2003, also in the name of the inventor hereof. Both of these patents and their contents are incorporated herein in their entirety by reference.

Accordingly, the various preferred embodiments of the present invention comprise structural and operative features which facilitate use of the umbrella assembly on an "open fisherman" type of boat, as well as on other marine craft and during conditions unique to the boating environment in which the umbrella assembly may be used. The referred to conditions are meant to include steady and/or strong wind conditions, as well as sudden or sporadic bursts of wind, the rocking and/or other movement of the boat, including the occasional and somewhat erratic or extreme movements of such boats during adverse weather conditions, as well as the travel of the boat at relatively high speeds. More in particular, the additional structural and operative features of the frame assembly incorporated into umbrella assembly 10 allow it to be maintained in its open or expanded position as demonstrated in FIGS. 1, 1-A, 7 through 9, and 14, during such conditions, including the travel of the boat at speeds over 30 mph, up to a range of about 50 mph, as will be described in greater detail hereinafter.

Therefore, the umbrella assembly 10 includes a frame assembly specifically structured to facilitate the mounting or positioning of the umbrella assembly 10 on a boat or marine craft 15 such as, but not limited to and "open-fisherman" type of boat. Further, the umbrella assembly 10 and its operative frame assembly is specifically structured to allow travel of the boat through water at relatively high speeds while the umbrella assembly 10, and more particularly, the canopy 20, is maintained in an open, expanded and operative position as demonstrated in FIGS. 1, 1-A, 7-8 and 14. One feature of the umbrella assembly 10 is the orientation of the canopy structure 20, when in its open, operative position, wherein the canopy 20 is structured to assume a substantially outwardly extending and ideally, flat configuration. Such a flat configuration, while providing significant shade to the occupants of a boat, also offers a minimal amount of wind resistance, especially while the boat is traveling at relatively high speeds.

As shown in FIGS. 2 and 7-9, in one embodiment of the present invention, the frame assembly comprises a plurality of support struts 22, having their inner or proximal ends pivotally secured to the hub assembly, and preferably, to a main hub member 18. The outer ends of each of the support struts 22 are preferably secured to a correspondingly positioned, outwardly extending rib 24. Somewhat similarly, the proximal end of the rib 24 is pivotally secured to a secondary hub or yoke type structure 26 as explained in detail with reference to FIGS. 2 through 6. As set forth in detail in the above-noted U.S. patents, namely, U.S. Pat. Nos. 6,889,699 and D478,416, the plurality of struts 22 may vary in number and length. Similarly, the number of ribs 24 may also vary in number and dimension dependant upon the overall configuration which the canopy 20 is intended to assume. With reference to FIGS. 10 through 13, a plurality of configurations of the canopy 20 are demonstrated. However, the plurality of configurations disclosed are by way of example only, in that a number of different configurations may be assumed by the canopy 20 dependant upon the size, number, dimension, etc. of the plurality of ribs 24 and their associated conventional supporting struts 22.

With further reference to the hub assembly, and as described in detail in the above-noted U.S. patents, namely, U.S. Pat. Nos. 6,889,699 and D478,416, the main hub 18 and the secondary hub 26 may be movable, such as being rotatable about the pole 12. This allows the plurality of ribs 24, the plurality of struts 22 and the canopy 20 to be selectively or otherwise rotated about the pole 12. Therefore, the location of the shade created by the canopy 20 can be changed to cover different areas on the boat or other environment in which the umbrella assembly 10 is located. This adjustability feature may be particularly advantageous when the canopy structure has a configuration of the type disclosed in FIGS. 10 through 13.

Figure 2:
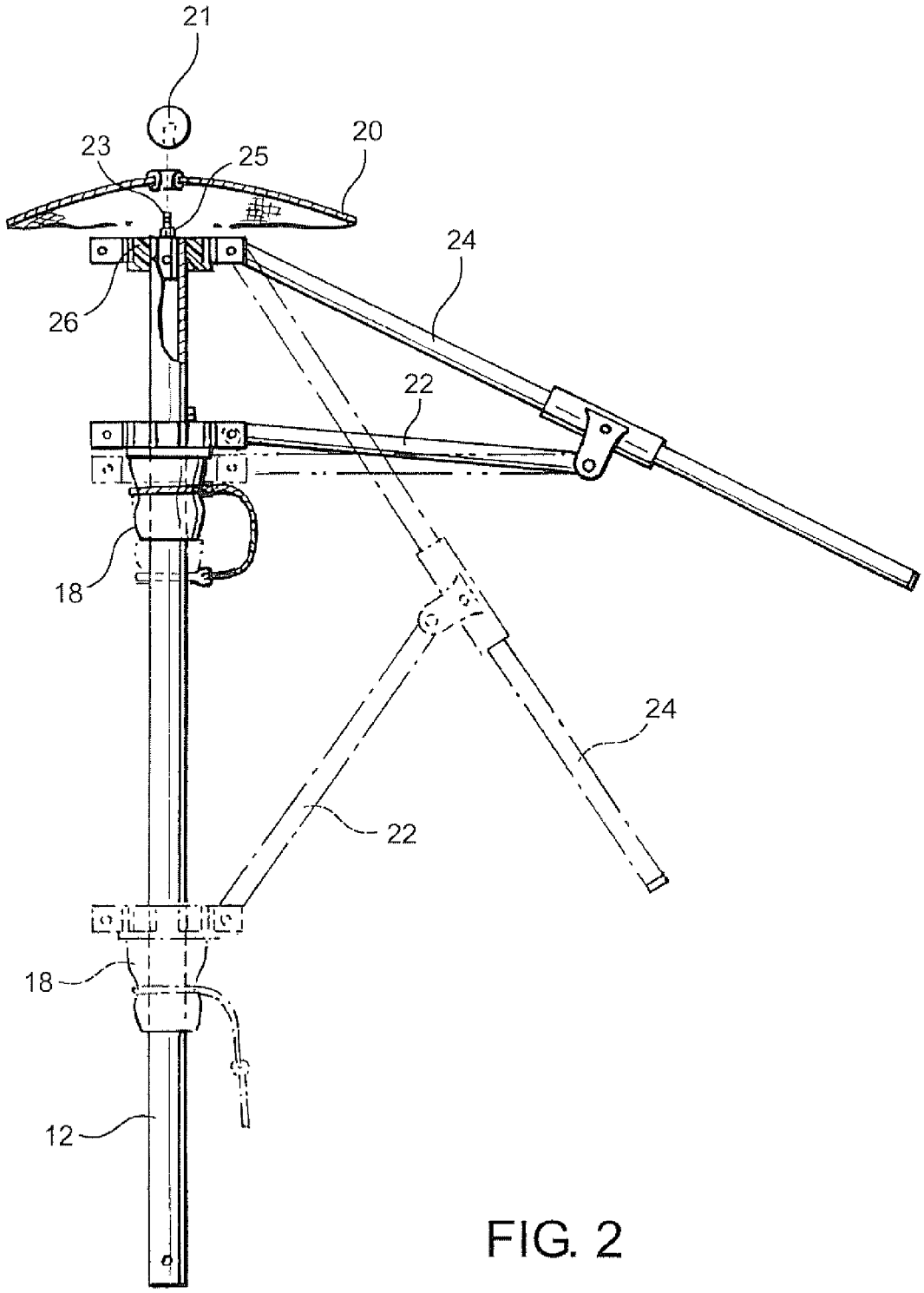
FIG. 2 is a front view in partial phantom and section of a potion of one embodiment of a frame assembly of the umbrella assembly of the present invention.
Figure 3:
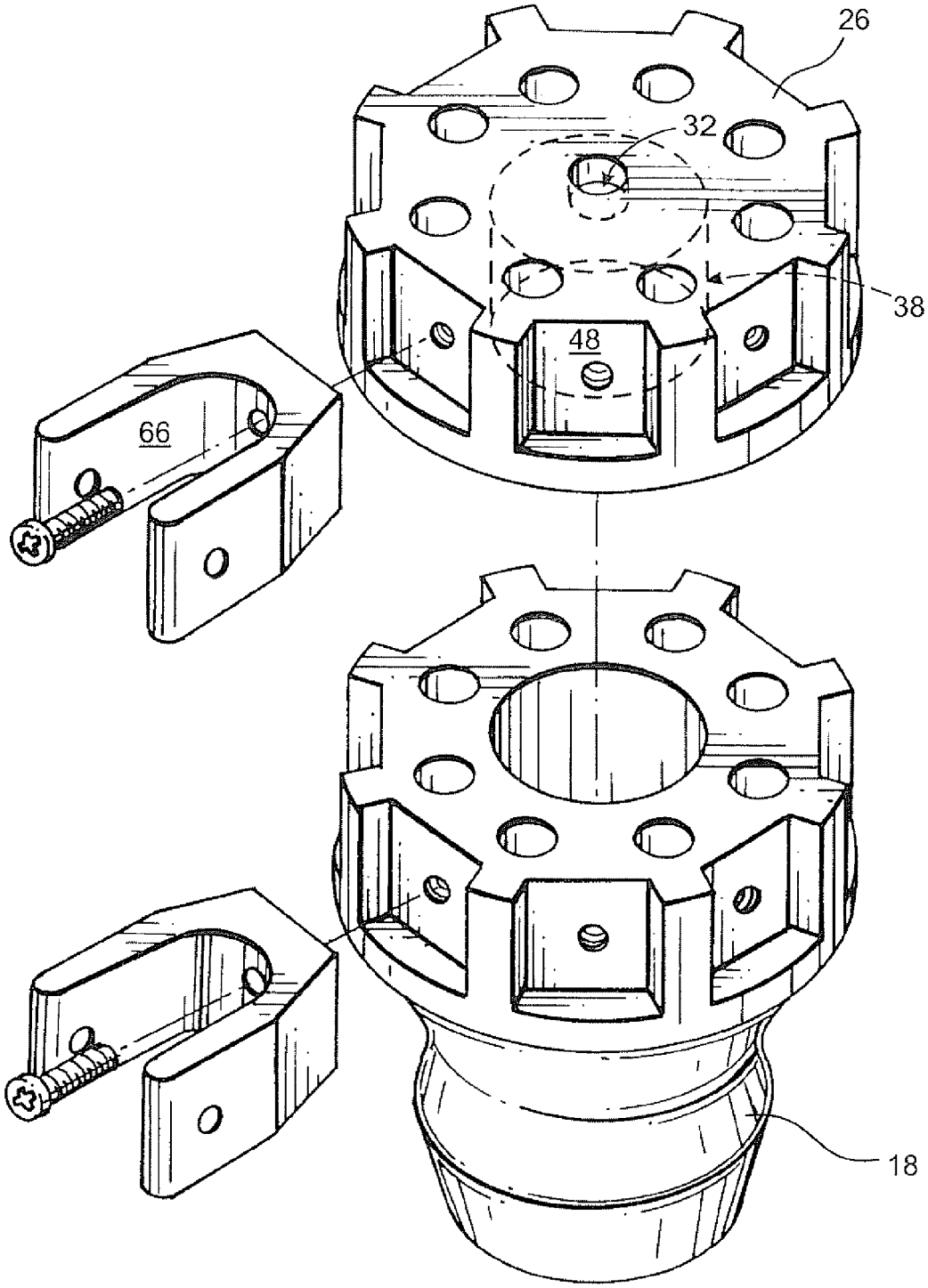
FIG. 3 is a perspective view in exploded form of a preferred hub assembly associated with at least one embodiment of the frame assembly of the present invention.
Figure 5:
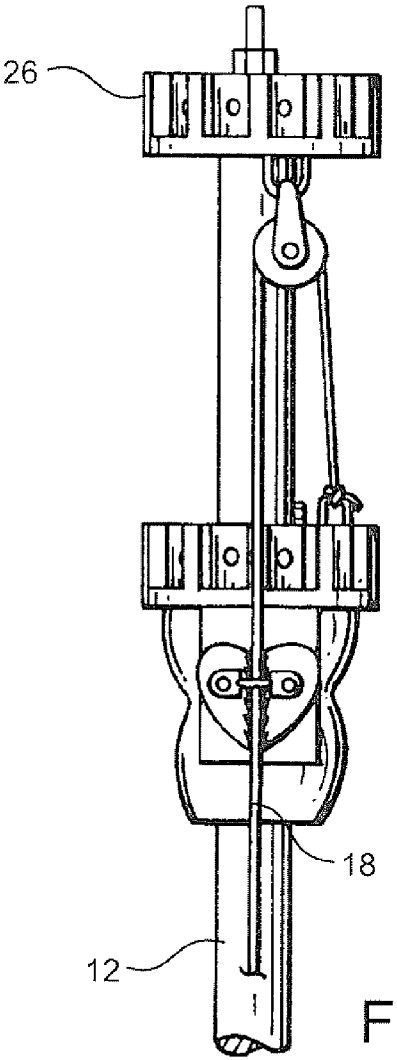
FIGS. 4 and 5 are front and side, partial cutaway views respectively, of the hub assembly shown in FIG. 3 in one possible assembled orientation.
Figure 4:
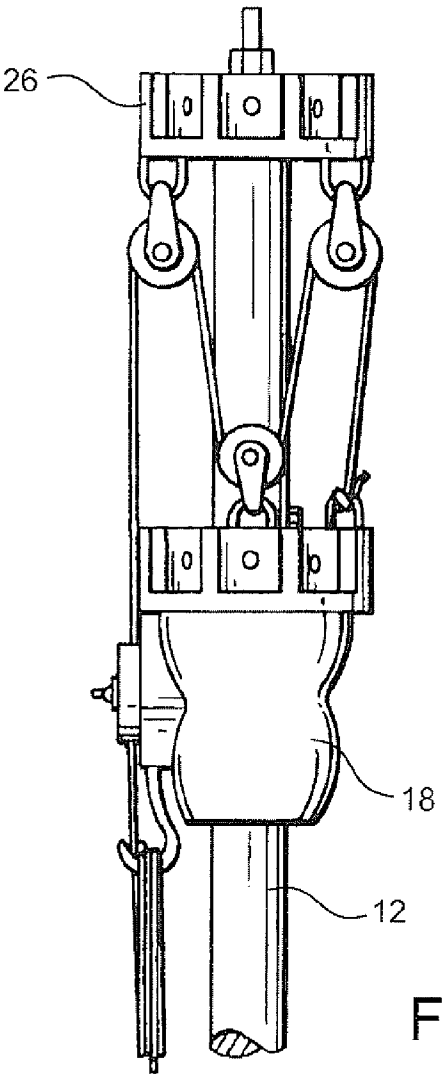

It should be understood from the various drawings that the main hub 18 is movably and axially attached to the pole 12, such as but not limited to via a central cavity shown in FIG. 3, and is therefore, free to both rotate about and slide along the pole. In addition, the main hub 18 may be maintained in a vertical position along the length of the pole 12 in several ways. For example, and as shown in FIG. 2, one way utilizes a retaining pin attached to the main hub 18 which can be placed within a retaining pin slot in the pole 12 in order to maintain the vertical position of the main hub 18 along the pole member 12. As shown in FIG. 2, the retaining pin can be maintained around the main hub by a looped line which allows the main hub 18 to rotate without binding the looped line. As another example, and with reference to FIGS. 4 and 5, the main hub 18 can be easily moved up and down the pole with the aid of a line member and one or more pulleys to selectively position the frame assembly in an open, closed or partially closed position. In the more preferred embodiments, the main hub 18 may be held in a position along the pole 12 by virtue of a cleat member, such as but not limited to a cam cleat or a jam cleat, which may be secured to the main hub 18 or to the pole 12 or to another part of the frame assembly. By way of example, a cam cleat member may include a pair of cams, each having a toothed side edge and a retaining bracket portion. In a rested position, the toothed side edges of the pair of cams face one another. Using the pulley system when the umbrella is in its closed position with the main hub 18 near the bottom end of the pole 12, the user can pull the line member through the pulley member and the toothed side edges, which will cause the pair of cams to pivot such that the line member will continue to be pulled, which will pull main hub 18 upward so as to open the umbrella. When the user stops pulling the line member, the cams will reverse pivot and the toothed side edges will engage and prohibit the movement of the line member in either direction. The main hub 18 will thereby be maintained in a vertical position along the pole 12 while permitting rotation of the main hub 18 and the secondary hub 26, and the associated rib members, strut members, and umbrella canopy attached thereto, about the longitudinal axis of the pole 12. In this way, the umbrella can be quickly and easily opened to and maintained at any desired position without the use of a hand crank or a retaining pin placed below the main hub 18. When the umbrella is desired to be closed, the line member can be pulled outside of the grip of the toothed side edges and released. The retaining bracket portion maintains the line member in alignment with the toothed side edges, such that the user can easily re-engage the line member with the toothed side edges so as to lock the line member at the desired vertical position. Only the intentional removal of the line member from the toothed side edges with a deliberate sideways and upward movement will allow the umbrella to close. Thus, in such an embodiment the toothed side edges of the described cam cleat member prevent any unintentional closing of the umbrella from wind gusts or other outside forces.

Figures 6, 6A:
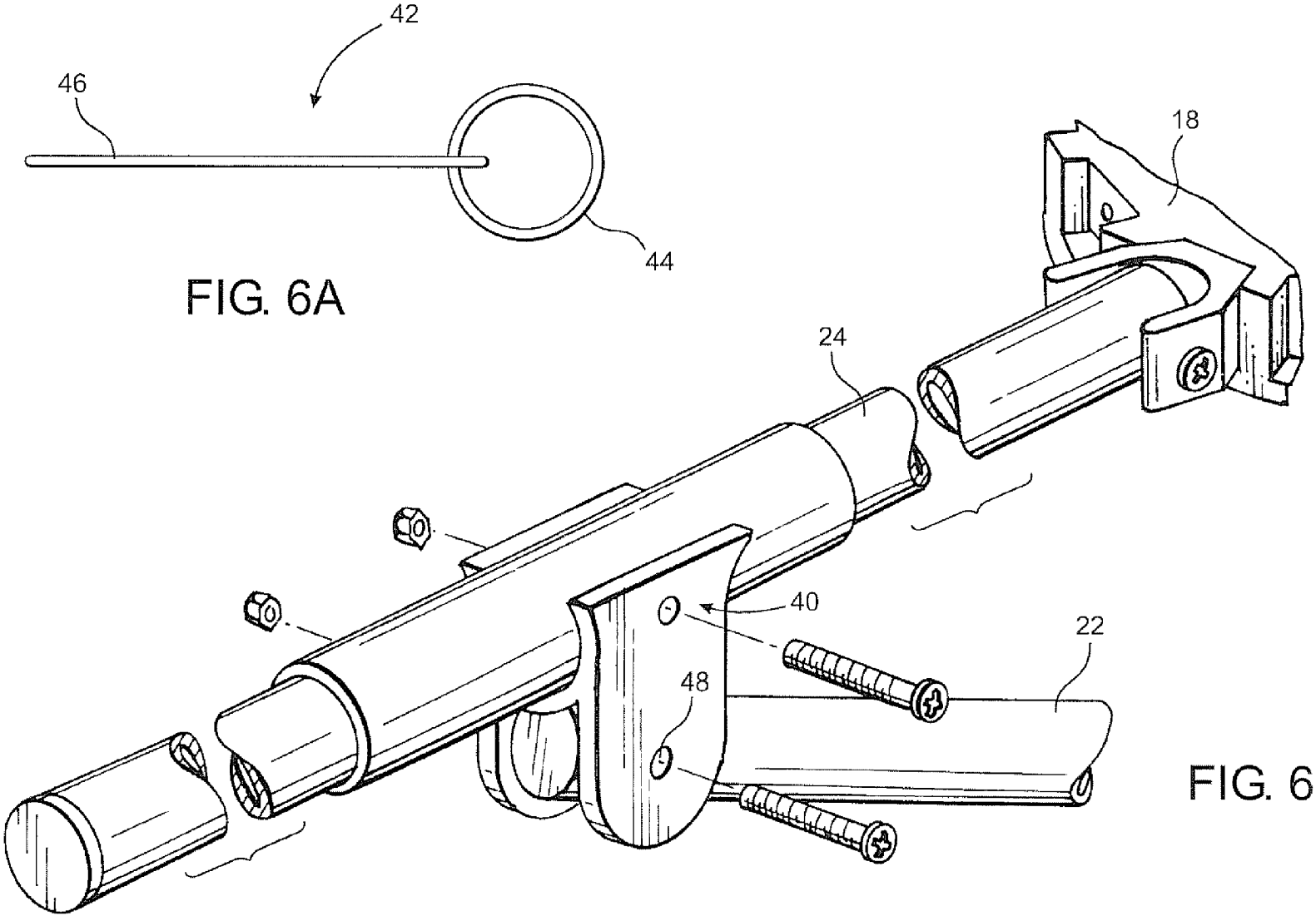
FIG. 6 is a partial, cutaway and perspective view of interconnecting means for correspondingly positioned strut and rib members of the frame assembly of the present invention.
FIG. 6A is a detailed view of a pull pin connector associated with the interconnecting means illustrated in FIG. 6.
Figure 7:
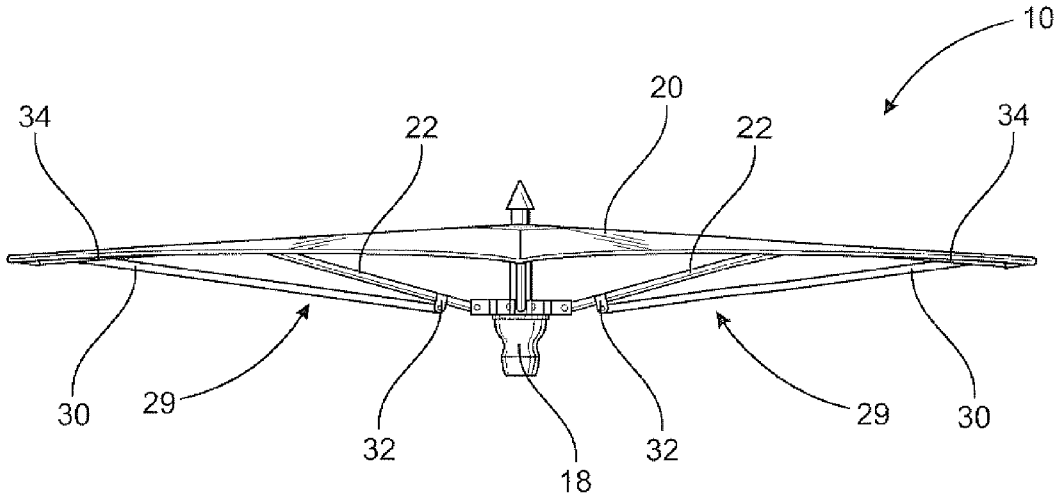
FIG. 7 is a detailed side view of the embodiment of FIG. 1 wherein a portion of the frame assembly includes a reinforcing assembly including auxiliary strut members disposed in an operative, supporting orientation.
Figure 8:
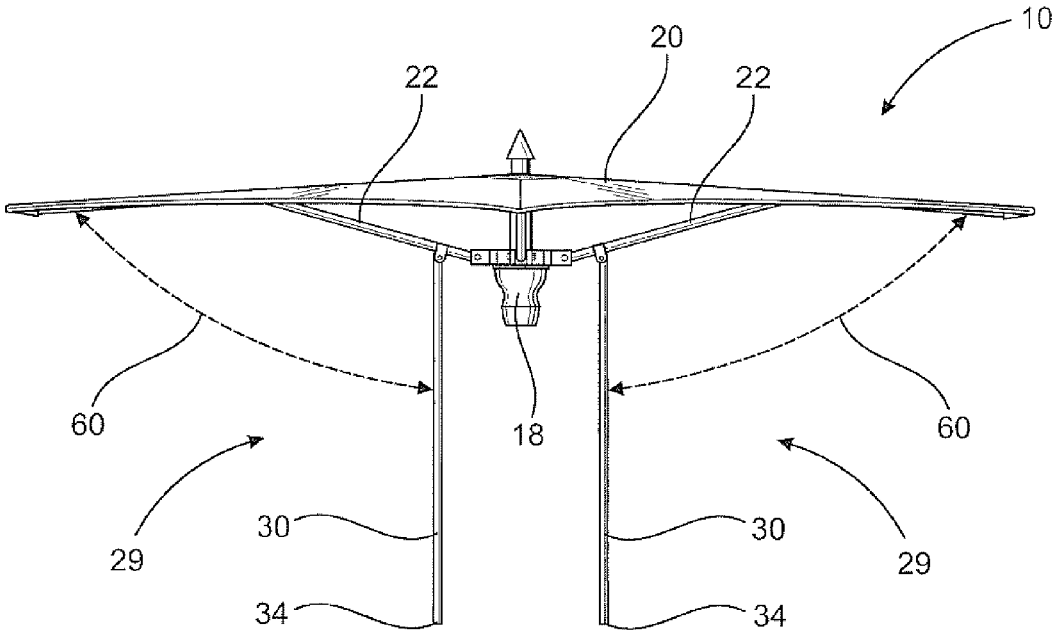
FIG. 8 is a detailed front view of the embodiment of FIG. 7 with the auxiliary strut members disposed in an at least partially disconnected orientation.
Figure 9:
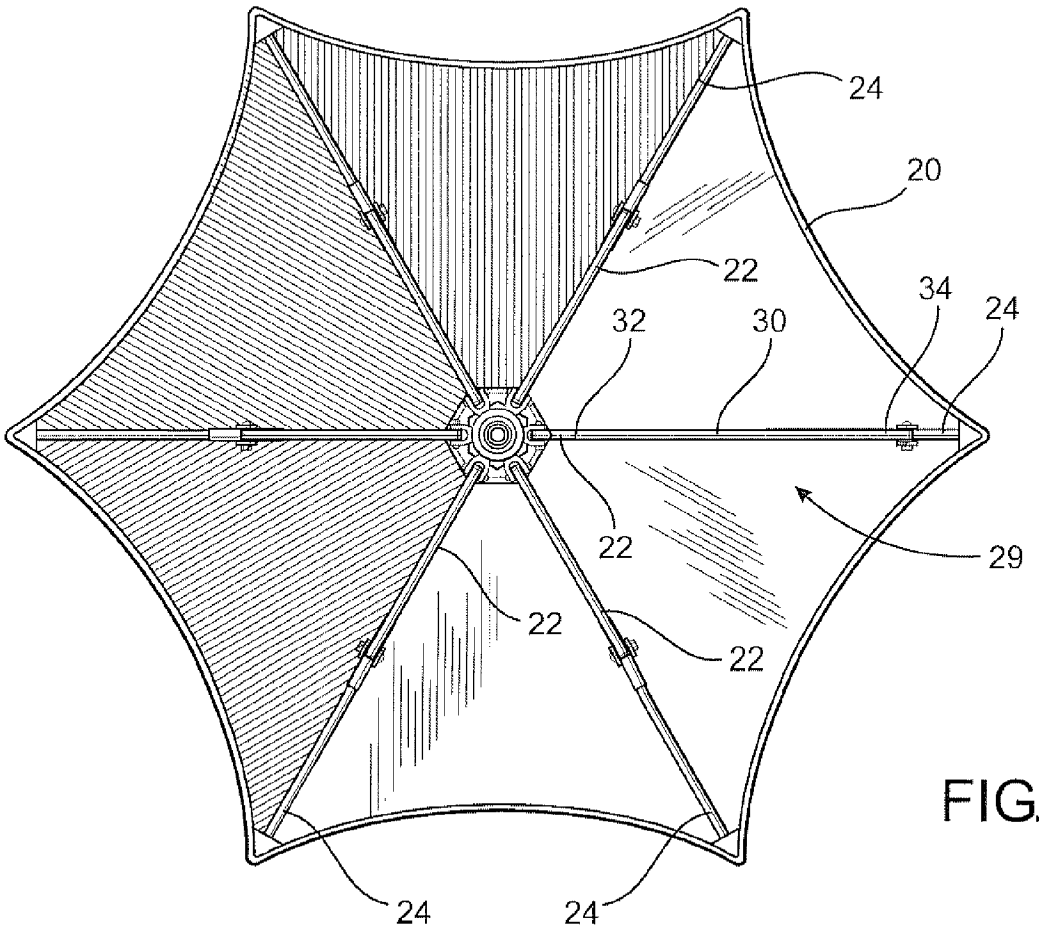
FIG. 9 is a partial bottom view of the frame assembly illustrated in FIG. 1, including the rib and strut members associated with the support of a canopy.
Figure 10:
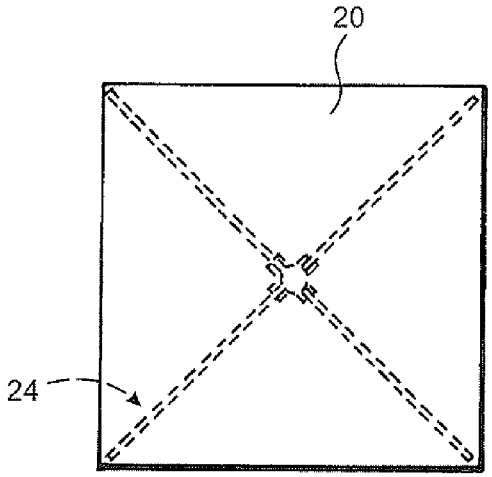
FIG. 10 is a top view in partial phantom of one of a plurality of configurations which the canopy may assume utilizing a different embodiment of the frame assembly of the present invention.
Figure 11:
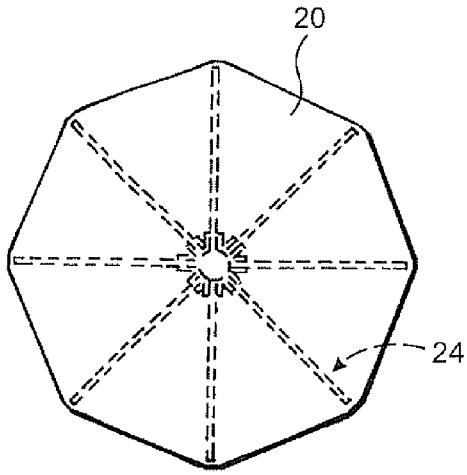
FIG. 11 is a top plan view of yet another embodiment demonstrating one of a plurality of shapes the canopy may assume utilizing another different embodiment of frame assembly of the present invention.
Figure 12:
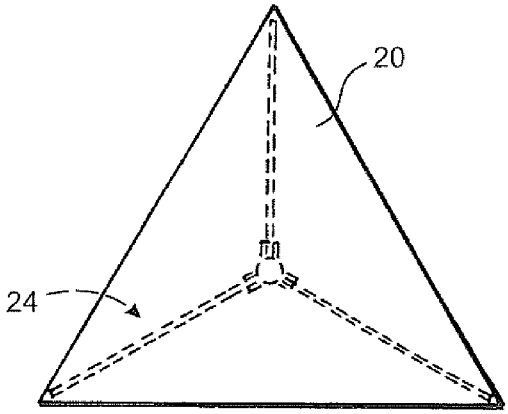
FIG. 12 is a top plan view of yet another embodiment demonstrating one of a plurality of shapes the canopy may assume utilizing yet another embodiment of the frame assembly of the present invention.
Figure 13:
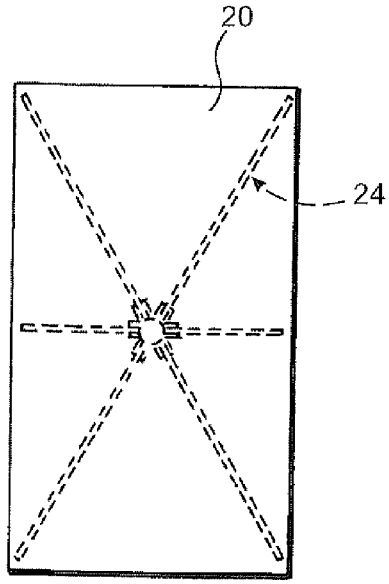
FIG. 13 is a top plan view of yet another embodiment demonstrating one of a plurality of shapes the canopy may assume utilizing another embodiment of the frame assembly of the present invention.

In order to increase the strength and structural integrity of the frame assembly and thereby by provide proper and adequate support to the canopy structure 20, especially during high wind conditions, the invention is provided in the preferred embodiments with a reinforcing assembly, generally indicated as 29 in FIGS. 7 through 9. The reinforcing assembly 29 facilitates the maintenance of the canopy 20 in an open condition during high wind conditions, such as when the boat 15 is traveling, even at relatively high speeds. More specifically, the reinforcing assembly 29 includes at least one, but more practically, a plurality of auxiliary struts 30 which also may be loosely referred to as "wind struts." In the embodiment of FIGS. 1 through 9, the number of auxiliary struts 30 is preferably equal (but does not have to be) to the number of correspondingly positioned, interconnected struts 22 and ribs 24. For purposes of clarity, each of the plurality of correspondingly positioned ribs 24 and struts 22 can be considered and referred to herein as a rib and strut pair. As such, each of the plurality of ribs 24 is supported by a correspondingly positioned strut 22, which is disposed in interconnecting relation between that respective rib 24 and the main hub member 18.

Still referring to the reinforcing assembly 29 of the invention, the plurality of auxiliary struts 30 are easily and selectively positionable between a supporting, operative orientation as shown in FIG. 7, and a non-supporting orientation as shown in FIG. 8. In addition, each of the auxiliary struts 30 is preferably formed from a high strength, light weight material, such as, but not limited to, aluminum. The length of the auxiliary struts 30 may vary dependant on the intended, overall shape of the canopy 20. As set forth above, the configuration assumed by the canopy 20 when in its expanded or open, operative position may vary greatly, as demonstrated in FIGS. 1, 1-A, and 10 through 13. Therefore, the dimension, location and number of the conventional support struts 22 may also vary to properly orient the canopy 20 in the aforementioned preferred configuration. Correspondingly, the number, dimension and overall structure of each of the plurality of auxiliary struts 30 may vary accordingly. When in their operative orientation as shown in FIG. 7, each of the auxiliary struts 30 are interconnected to a different one of the correspondingly positioned rib and strut pairs. More specifically, when in an operative orientation, the auxiliary struts 30 are interconnected between a support strut 22 and the corresponding rib 24.

Moreover, in order to facilitate quick and easy positioning of the plurality of auxiliary struts 30 in their operative, position shown in FIG. 7, a proximal end 32 of each auxiliary strut 30 is movably (or removably) connected to the corresponding rib member 24, preferably at a location substantially adjacent the hub member 18. The opposite or distal end 34 of each of the auxiliary struts 30 is preferably removably connected to a correspondingly positioned rib 24 substantially at or adjacent the distal end of the rib 24. As such, each of the auxiliary struts 30 may be quickly and easily pivoted into and out of their supporting orientation of FIG. 7, as indicated by phantom directional arrows 60 of FIG. 8. Yet another embodiment of the present invention comprises the auxiliary struts 30 being removably connected at both their proximal ends 32 and their distal ends 34, such that when positioning the canopy 20 in a closed orientation for storage, detachment and removal of the auxiliary struts 30 from the position shown in FIG. 8 may be easily accomplished.

Removable connection of each opposite end 32 and 34 of each of the plurality of the auxiliary struts 30 can be readily accomplished by a connector assembly represented in FIG. 6, and generally indicated as 40. Structural modifications of the connector assembly 40 of the type used to removably attach or connect both of the ends 32 and 34 to correspondingly position struts 22 and ribs 24 may include the use of a "pull-pin" connector member of the type shown in FIG. 6A and generally indicated as 42. The pull-pin connecter 42 would include a loop or like member 44 on which a pulling force could be exerted, wherein the elongated shaft 46 would pass through the aligned apertures as at 48 formed in both in the connector assembly 40 and the opposite ends 32 and 34 of the auxiliary strut 30. Upon removal of the plurality of auxiliary struts 30, they could be collectively stored with or in the general vicinity of the closed umbrella assembly 10 aboard the boat or other water craft 15 on which the umbrella assembly 10 is mounted.

However, while one embodiment of the present invention comprises the removal of the auxiliary struts 30, it is emphasized that the struts 30 can remain in the orientation of FIG. 8 and allow for the closing of the umbrella assembly 10, with the struts 30 still maintained in their non-supporting orientation. In this latter embodiment, the same or substantially similar connecting assembly 40 and 42 of FIGS. 6 and 6A can be used to pivotally or otherwise movably connect the proximal end 32 to a corresponding strut 22, as described above. With reference to FIG. 9, only a single auxiliary strut 30 is disclosed in its operative, supporting position for purposes of clarity. More specifically, the auxiliary strut 30 includes its proximal end 32 movably and/or removably connected to the correspondingly positioned, conventional support strut 22 and its opposite or proximal end 34 removably and moveably connected to the correspondingly disposed rib 24.

Referring now to FIGS. 14 through 24, the present invention is illustrated in more preferred embodiments and will now be described in detail. As shown in FIG. 14, the umbrella assembly 100 is represented in its expanded, operative position and mounted on a marine craft or boat, generally indicated as 102. Moreover, shade and protection from the sun and against other weather conditions are provided relative to at least some interior portions of the marine craft 102 and one or more occupants contained therein. This preferred embodiment of the umbrella assembly 100 is therefore readily adapted to be mounted on and used in connection with a marine craft or boat 102 represented in FIG. 14, even while the boat 102 is traveling at relatively high speeds, such as over 30 mph and/or in the range of up to about 50 miles per hour. Also, the marine craft 102 is disclosed in FIG. 14 as being representative of an "open fishermen" type of boat having a central steering or console area generally indicated as 103. However, as set forth above, and as further emphasized hereinafter, the various embodiments of the umbrella assembly 10 and 100 may be used on a variety of different marine craft which may vary significantly in size, style and purpose. Clearly, the umbrella assemblies 10 and 100 are also structured to be used on land, especially in areas which encounter high or strong wind conditions.

Also, regardless of the type of marine craft 102 with which the umbrella assembly 100 is utilized, the base, referred to as 14 or 14' in the embodiment of FIGS. 1 and 1A may also vary significantly. As represented in FIG. 14, the base to which the umbrella assembly 100 is connected may be part of the structure of the marine craft 102 such as, but not limited to, the console 103' to which a support pole 104 is removably connected. As with the previously described preferred embodiments of the present invention, the removal but stable connection of the support pole 104 to the base 103' facilitates selective disposition of the umbrella assembly 100 between the expanded, operative position of FIG. 14 and a closed, collapsed position for storage when not in use.

Figure 19:
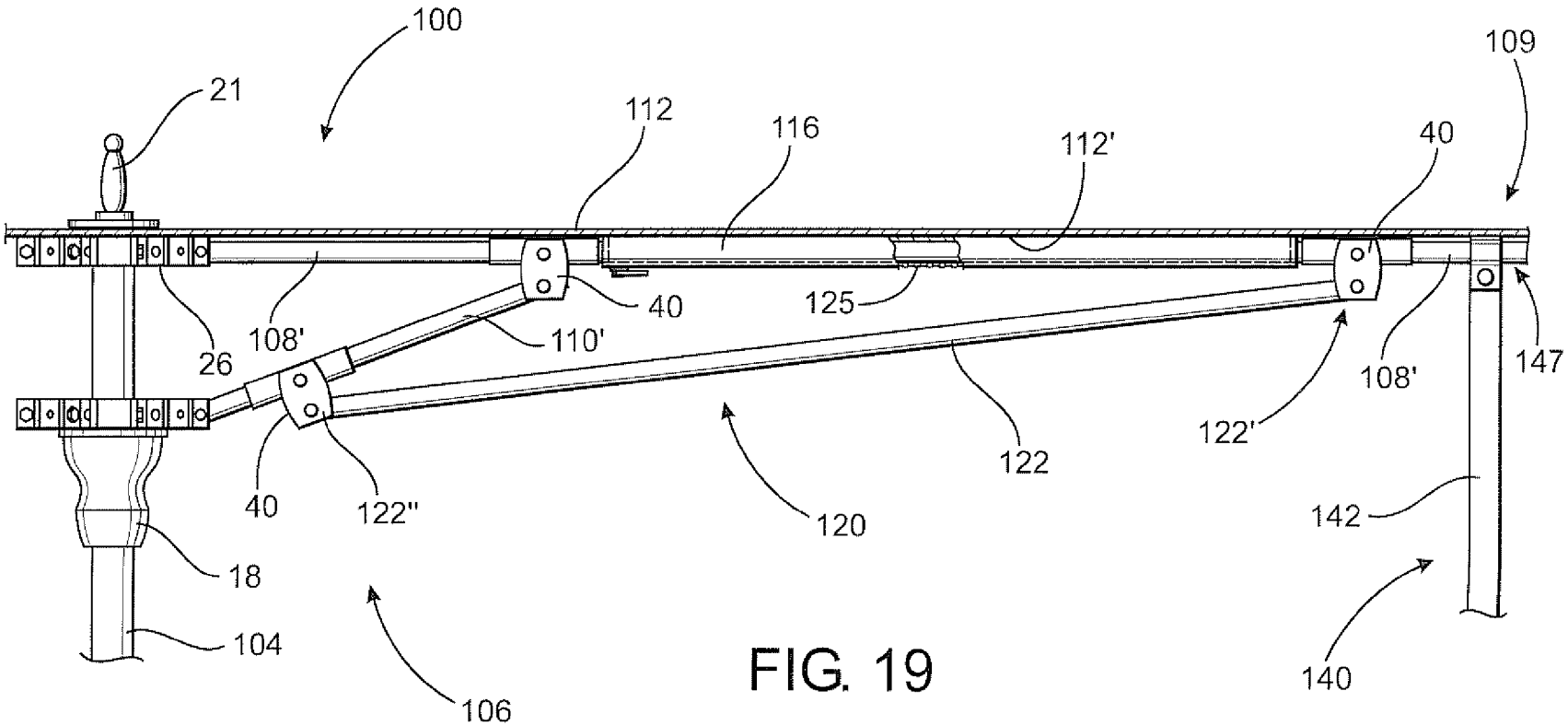
FIG. 19 is a detailed side view in cross section and partial cutaway of the various frame assembly components associated with the preferred embodiment of the umbrella assembly as represented in FIGS. 14-18.
Figure 20:
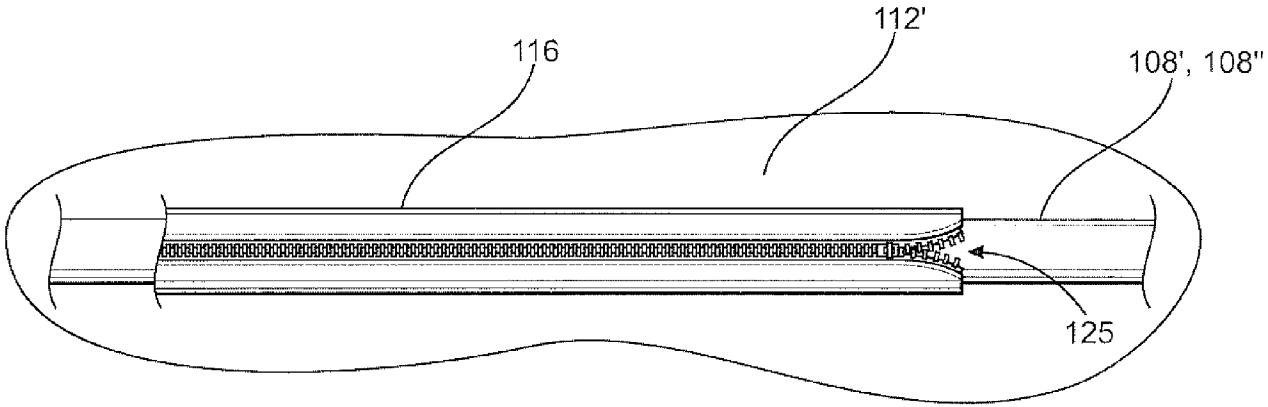
FIG. 20 is a detail view in partial cutaway of one preferred embodiment of an anchor assembly for connecting the canopy to a frame assembly of the umbrella assembly of the embodiment of FIGS. 14-19.

Other structural and operative features of the umbrella assembly 100 include a frame assembly generally indicated as 106 in FIG. 19, and represented in detail in FIGS. 15-19. More specifically, the frame assembly 106 includes a support pole 104 and a plurality of ribs 108 pivotally or otherwise movably connected at an innermost end through the support pole 104, such as by the secondary hub 26 as shown in detail in FIG. 3. While it is apparent that the overall size, configuration, orientation, etc. of the embodiment of FIGS. 14-24 may vary from the embodiment of FIGS. 1 and 1A, certain structural components may be common to each of these embodiments.

More specifically, the plurality of ribs 108 are substantially equivalent in structure and operation to the plurality of ribs 24. Also, the frame assembly 106 includes a plurality of struts 110 which may be structurally and operatively equivalent to the struts 22 as shown in detail in FIGS. 2 and 6 of the umbrella assembly 10 and 10'. Minor structural modifications may exist, such as the position and overall dimension of the ribs and struts 108 and 110, as compared to the ribs and struts 24 and 22 of the preferred embodiments of the umbrella assemblies 10, and 100. Also, selective positioning of the frame assembly 106, as well as the canopy 112, between the aforementioned expanded, operative position of FIGS. 1 and 15-19 and the collapsed, stored position may be accomplished through the provision of a line and pulley assembly, such as but not limited to those illustrated in FIGS. 4 and 5. As disclosed in these Figures, the secondary hub 26 is fixed to the upper end of the support poles 12 and 104 and the main hub 18 is movable along the length of the respective support poles 12 and 104. These features are more fully described in the above referenced patent and/or application to the inventor herein which, as set forth above, are incorporated in their entirety by reference. In order to further clarify the detailed description of the preferred embodiments of FIGS. 14 through 24, it is noted that each of the plurality of ribs 108 is correspondingly positioned relative to one of a plurality of struts 110. As such, correspondingly positioned ones of the ribs and struts 108 and 110 may be referred to herein as rib and strut pairs.

The canopy 112 is connected to and supported on the plurality of ribs 108 and has an inner or substantially central portion connected to the support pole 104 such as by a coupling or connecting member 21. Attachment of the canopy 112 in its supported position on the plurality of ribs 108 may be accomplished by a removable attachment or connection at least partially defined by the outermost end of each of the ribs 108 being removably disposed within pockets or receiving portions 114.

As will now be explained in greater detail, the preferred embodiment of FIGS. 14-24 also includes the provisions of an anchor assembly. The anchor assembly preferably comprises at least one, but more practically, a plurality of anchor members 116 shown in detail in FIGS. 15-A and 19. The anchor assembly and the plurality of anchor members 116 facilitate the maintenance of the canopy 112 in the expanded, operative position demonstrated in FIGS. 14, 15 and 19, even when the umbrella assembly 100 encounters high or strong wind conditions, such as when mounted on or within a marine craft 102 as it travels at relatively high speeds. Each of the one or more anchor members 116 is structured to be removably connected to the frame assembly 106, and more specifically, to the ribs 108 of "predetermined" rib and strut pairs. The one or more predetermined rib and strut pairs may be defined by one or more rib and strut pairs 108', 110' located at a leading portion 109 of the frame assembly 106, as well as one or more rib and strut pairs 108", 110" located at the trailing portion 111 of the frame assembly 106.

With reference to the position and/or orientation of the umbrella assembly 100 on the marine craft 102, the leading portion 109 is disposed adjacent or in general alignment with the front of the marine craft 102. In contrast, the trailing portion 111 is more closely associated with the rear portion of the marine craft 102, and is somewhat oppositely disposed to the leading portion 109, at least in the embodiment of FIG. 14. For purposes of describing the present invention, the designation of the leading and/or trailing portions of the frame assembly 106 is not necessarily related to the direction of travel of the craft 102.

As emphasized in the description of the embodiments of FIGS. 1-13, a reinforcing assembly 120 is incorporated in or otherwise associated with the frame assembly 106 in order to maintain the canopy and the frame assembly 106 in the intended, operative position, as represented in FIG. 14. More specifically, the reinforcing assembly 120 includes at least one, but more practically, a plurality of auxiliary struts 122, which are perhaps best illustrated in FIG. 19. Each of the one or more auxiliary struts 122 is disposed in supporting relation to one or more predetermined rib and strut pairs. As such, and still referring to FIG. 19, the auxiliary strut 122 is intended to be representative of all of the auxiliary struts 122 and is shown in interconnecting, supporting relation between a predetermined rib and strut pair defined by rib 108' and strut 110'. Further, each of the auxiliary struts 122 is preferably removably attached at opposite ends to the predetermined rib 108', as at 122' and/or to the strut 110', as at 122". In the embodiment of FIG. 19, the auxiliary strut 122 is represented as being pivotally attached at each of its opposite ends 122' and 122", such as by a coupling 40.

However, a structural modification may include one or more of the opposite ends 122' and 122" being removably connected to the rib 108' and to the strut 110', such as by the structure described with reference to the embodiment of FIG. 6A. Accordingly, rather than being merely pivotally attached by the connector assembly 40, one or both of the opposite ends 122' and 122" may be removably connected using the pull pin connector member 42 shown in FIG. 6-A, including the elongated connecting shaft 46 and a pull loop 44. Such a removable connection of one or both ends 122' and 122" of each auxiliary strut 122 further facilitates the selective disposition of the umbrella assembly 100 between the expanded, operative position and a collapsed, folded position. The auxiliary struts 122 shown in FIG. 19 may also be movably disposed along an arcuate path, such as that shown in FIG. 8 at reference numeral 60, when the auxiliary struts 122 are disposed into or out of a supporting connection with the predetermined rib and strut pairs.

In a most preferred embodiment, at least partially dependent on the size and overall configuration of the frame assembly 106 and the canopy 112, a predetermined one or more of the rib and strut pairs 108', 110' may be located at the leading portion 109 of the frame assembly 106 of the umbrella assembly 100. Moreover, the auxiliary struts 122 may be located in supporting interconnection with the one or more trailing rib and strut pairs 108", 110" located at the trailing portion 111 of the frame assembly 106, as represented in FIGS. 15, 15A, 16-18. Therefore, the predetermined one or more rib and strut pairs to which the one or more auxiliary struts 122 are attached are herein defined as one or more leading rib and strut pairs and one or more trailing rib and strut pairs. However, others of the plurality and rib and strut pairs could also be selected to be directly associated with the one or more auxiliary struts 122, as demonstrated in the description of the embodiment of FIGS. 1 through 13. The selection of specific ones of the rib and strut pairs to be supported by the auxiliary strut 122 may be dependent upon the size and configuration of the umbrella assembly 100, as well as its location on the marine craft 102. Similarly, when the umbrella assembly 100 is land based the placement of the auxiliary struts 122 may be at least partially determined by the predominant direction of the wind flow relative to the specific disposition of the umbrella assembly 100.

Accordingly, the reinforcing assembly 120 facilitates maintenance of the canopy 112 and frame assembly 106, as well as the remainder of the umbrella assembly 100 in its intended, expanded, operative position, while the marine craft 102 is traveling at relatively high speeds. In addition, the aforementioned anchor assembly, comprising one or more anchor members 116 further facilitates maintenance of the canopy 112 in its intended, operative position as demonstrated in FIGS. 1, 15, 19 and 24 by assuring a stable but removable attachment of the canopy 112 to predetermined ones of the rib and strut pairs. More specifically, the reinforcing assembly 120 comprises each of the one or more auxiliary struts 122 being "commonly connected" to the predetermined rib and strut pair 108', 110' and 108", 110" to which the one or more anchor members 116 are connected.

As clearly demonstrated in FIG. 19, each of the one or more anchor members 116 is connected to and extends along an intermediate length of predetermined ribs 108' and/or 108" between opposite ends thereof. As such, in a most preferred embodiment each of the one or more anchor members 116 comprises an elongated, longitudinally open, sleeve or like structure fixedly secured to the canopy 112 such as, but not limited to, an inner surface 112' thereof and in aligned, connecting relation to the respective, predetermined ribs 108' and/or 108". In addition, each of the sleeves of the anchor members 116 preferably includes, but does not have to include, an elongated connector assembly such as that designated by reference numeral 125, 126, 127, 128, in FIGS. 20-23 respectively, extending along at least a majority or other appropriate portion of the length of the respective anchor members 166 and connected to opposite longitudinal edges of the sleeve or like structure. It is again pointed out, however, that the anchor member 116 does not have to be include a connector assembly which makes it readily removable from the rib 108.

Figures 15, 15A:
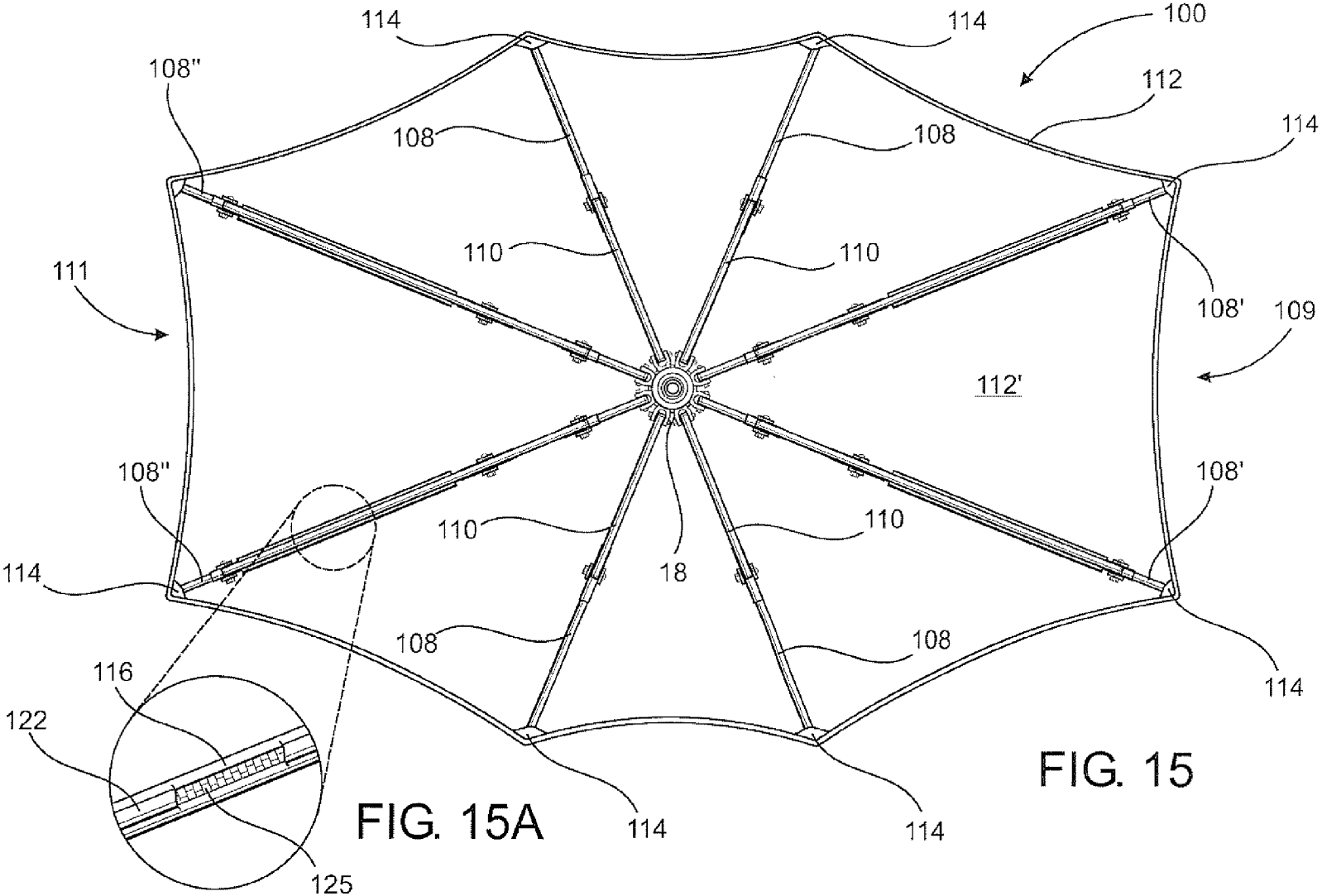
FIG. 15 is a bottom or underside view of the frame and canopy structures associated with the preferred umbrella assembly shown in FIG. 14.
FIG. 15A is a detailed view of a portion of the frame of the embodiment shown in FIGS. 14 and 15.
Figure 16:
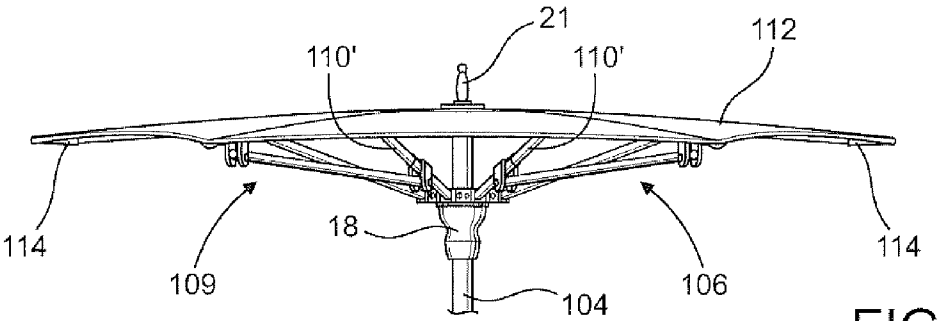
FIG. 16 is a front view disclosing a leading portion of the umbrella assembly of the embodiment of FIGS. 14 and 15.
Figure 17:
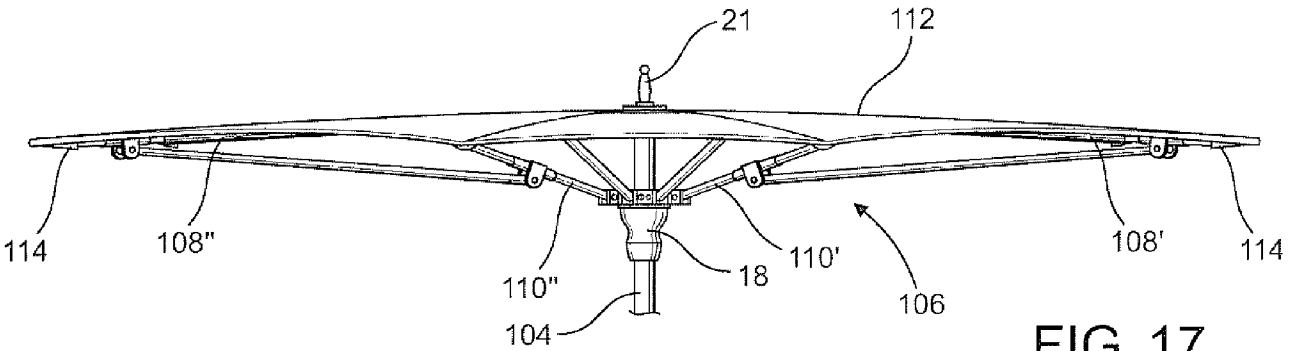
FIG. 17 is a side view of the embodiment of the umbrella assembly in FIGS. 14-16.
Figure 18:
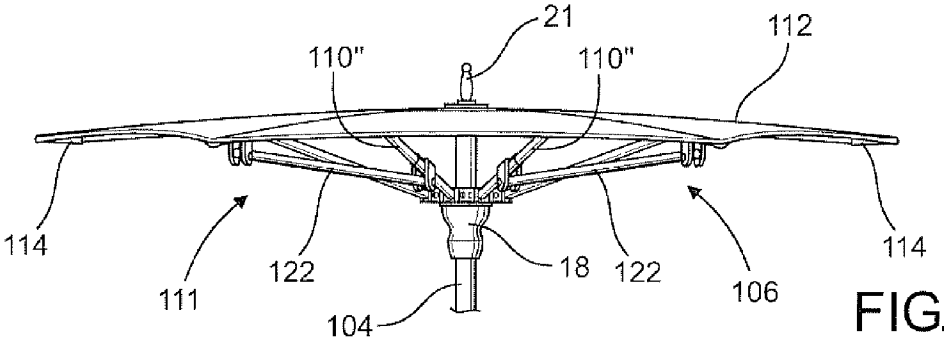
FIG. 18 is a rear view disclosing a trailing portion of the umbrella assembly of the embodiments of FIGS. 14-17.
Figure 21:
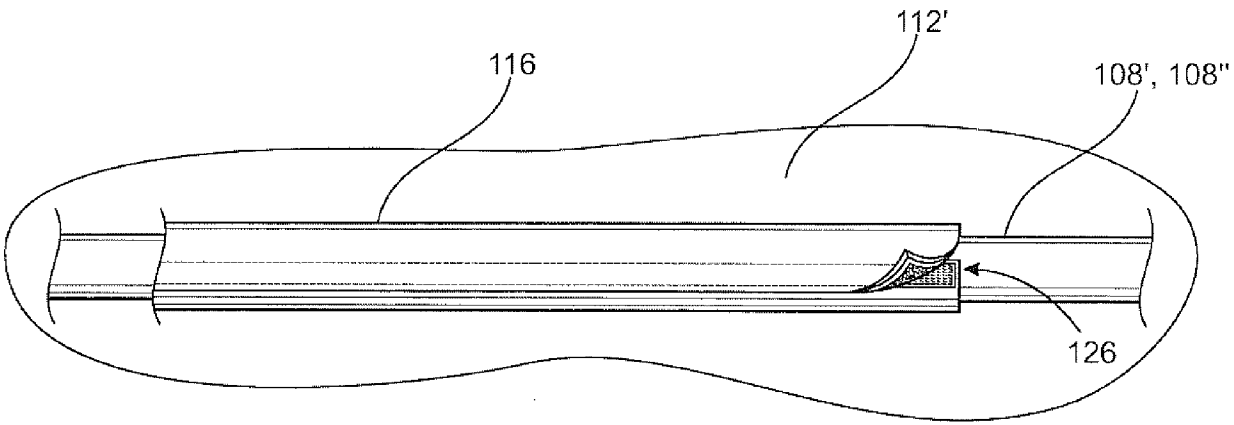
FIG. 21 is yet another preferred embodiment of the anchor assembly.
Figure 22:
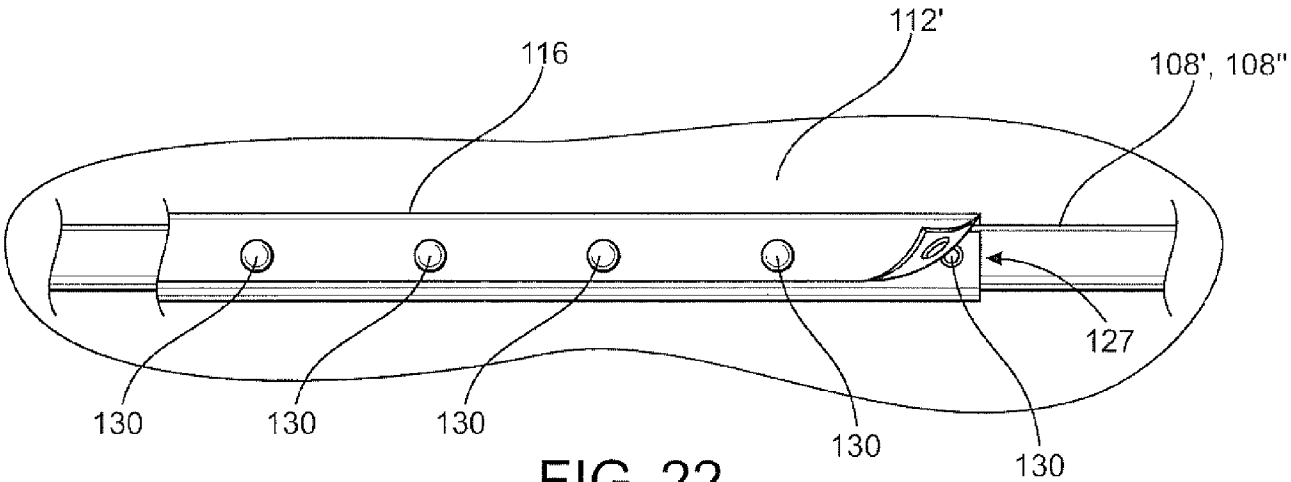
FIG. 22 is yet another preferred embodiment of the anchor assembly.
Figure 23:
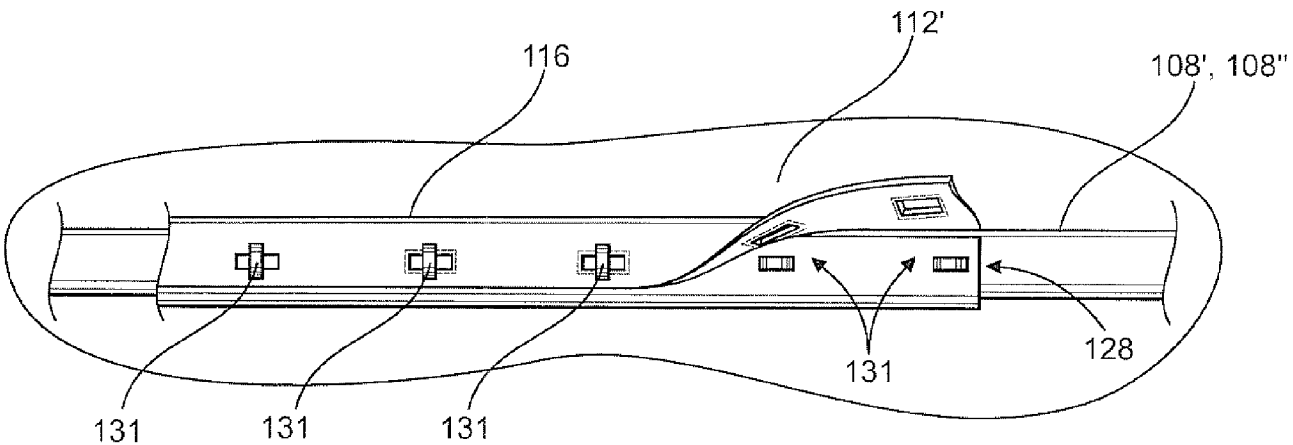
FIG. 23 is yet another preferred embodiment of the anchor assembly.
Figure 24:
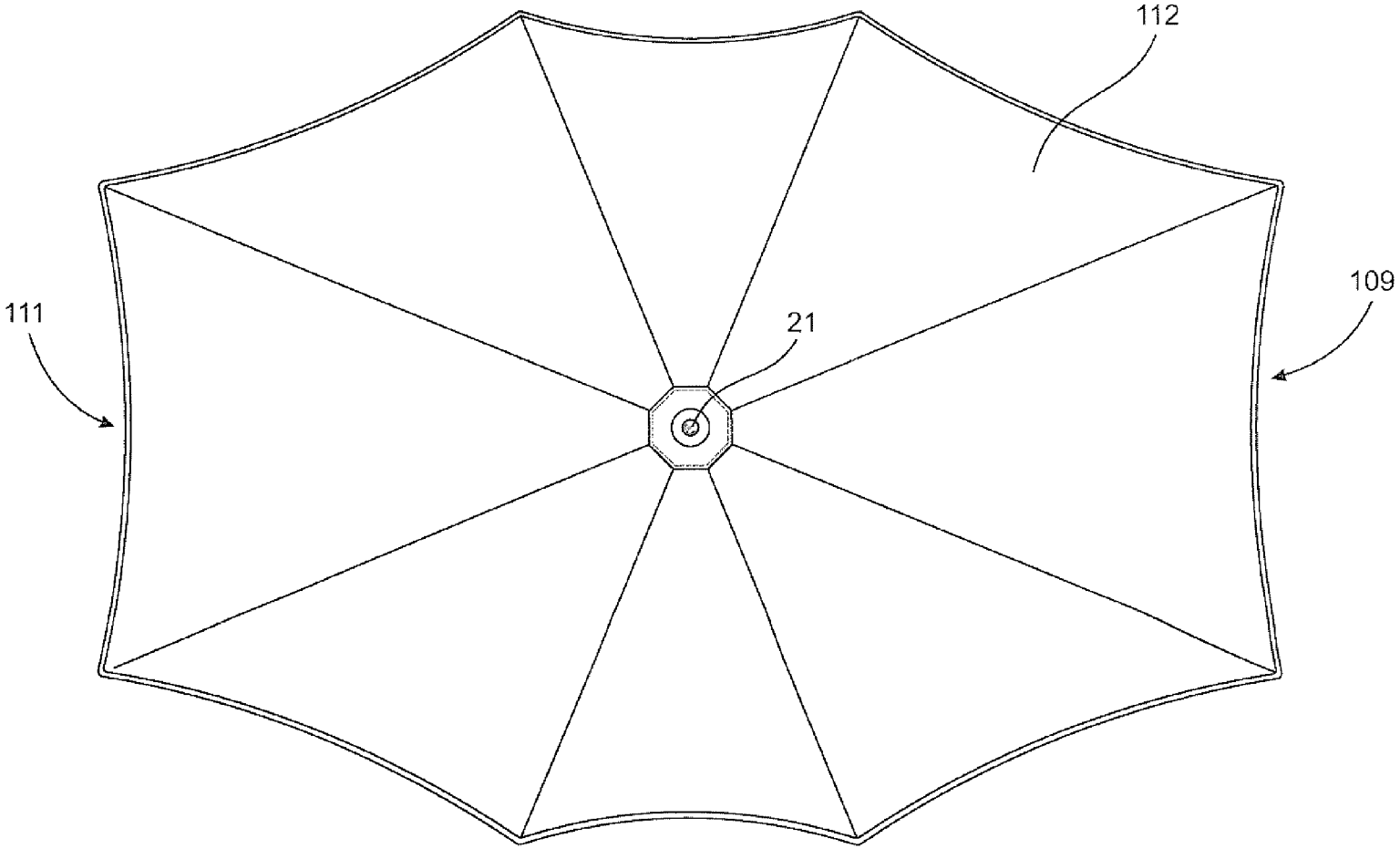
FIG. 24 is a top view of the canopy of the preferred embodiment of the umbrella assembly as represented in FIG. 14.

More specifically, and with primary reference to FIGS. 20 through 23, each of the connector assemblies 125, 126, 127, 128, etc. is structured to removably secure the opposite longitudinal edges of each of the anchor members 116 to one another. Further, the plurality of connector assemblies 125-128 are representative of any of a larger number of possible connector assembly structures that may be used to removably interconnect the opposite longitudinal edges of each of the sleeves of the anchor members 116, so as to removably attach the anchor members 116 to intermediate lengths of the predetermined ribs 108', 108", etc. By way of example only, in FIG. 20 the connecter assembly 125 is at least partially defined by a zipper structure. In contrast, and as shown in FIG. 21, the connecter assembly 126 comprises a hook and loop type fastener extending along the entire or at least a significant portion of the length of the anchor member 116. Additional possible embodiments of the connecter assemblies represented as 127 and 128 in FIGS. 22 and 23, include a plurality of connector members 130 and 131, respectfully defined by a plurality of snap connecters and/or a plurality of turn buckle connecters. While the length of each of the sleeve like anchor members 116 may vary, as well as the overall structure thereof, it is preferred that each of the anchor members 116 extends along at least predetermined portion of the length of the selected ribs 108', 108", etc., intermediate opposite ends of the ribs. For purposes of clarity, FIG. 15A represents a detailed view in partial cutaway and schematic form disclosing the relative positions of the auxiliary struts 122, anchor members 116 and a connector assembly 125, associated with the anchor members 116.

Referring now to FIGS. 14 and 19, the umbrella assembly 100 according to the present invention may also include, but does not have to include, a restraining assembly as generally indicated by reference numeral 140. In the illustrated embodiment, the restraining assembly 140 may include a plurality of restraining members 142. The disposition and structure of the restraining assembly 140 and the one or more restraining members 142 serve to retain the canopy as well as the frame assembly 106 in the expanded, open, operative position as represented in FIG. 14.

More specifically, each of the restraining members 142 are disposed in interconnecting relation between predetermined ones of the rib and strut pairs and a supporting structure such as, but not limited to a structural portion of the marine craft 102 as at 145, demonstrated in FIG. 14. The portions of the marine craft 102 which may serve as the structural supports for the restraining members 142 may include different portions of the marine craft 102 as also demonstrated in FIG. 14. With reference to FIG. 19, an opposite end of each of the one or more restraining members 142 is connected to predetermined rib and strut pairs, as at 147. As set forth above, the predetermined rib and strut pairs to which the restraining members 142 are attached may preferably include rib pairs 108', 110', and/or 108", 110", to which the reinforcing assembly 120 and the anchor assembly are commonly connected.

As also set forth above, each of the one or more auxiliary struts 122 and the anchor members 116 are connected to a common rib and strut pair. Further, each of these predetermined rib and strut pairs are preferably located at a leading portion 109 and/or a trailing portion 111 of the frame assembly 106. Therefore, additional stability to the umbrella assembly 100 may be provided in one embodiment by a restraining assembly 140, and as illustrated more specifically, by one or more restraining members 142 being connected to, as at 147, to each of the one or more rib and strut pairs to which the auxiliary struts 122 and the corresponding anchor members 116 are commonly connected.

It is also emphasized that the representation of the restraining assembly 140 comprises each of the one or more restraining members 142 being defined by elongated flexible straps or lines, wherein the length and/or tension thereof may be adjusted or regulated by appropriate buckle or other type of adjustable connecters 149. However, another appropriate structure may define each of the restraining member 142 such as integral, one piece straps or lines or appropriately structured rods, shafts or like structures disposed in interconnecting relation between the supporting portions 145, 145' of the marine craft 102 and the predetermined rib and strut pairs, as demonstrated in FIG. 19 and generally indicated as 147.

Therefore, the various preferred embodiments of the umbrella assembly, as described above, include specific structural modifications and operative features which distinguish it from a conventional umbrella assembly. Such distinguishing features include, but are not limited to, the frame assemblies which facilitate the umbrella assembly being connected to and removed from a supporting base or like structure which can be secured to or generally considered a part of a marine craft. Further, the operative and structural features of the various preferred embodiments of the umbrella assembly allow it to be maintained in its open, operative position during high or strong wind conditions, such as wind conditions encountered when the marine craft is traveling at relatively high speeds.

The present invention may be embodied in other specific forms without departing from the spirit or essential characteristics thereof. Therefore, the embodiment(s) presented herein to illustrate this invention are to be considered in all respects as illustrative and not restrictive. In other words, the scope of the invention should not be limited by the foregoing description, but rather, should be considered as in connection with following claims, and all modifications or other changes which come within the meaning and range of equivalency of these claims are therefore intended to be embraced therein.

What is claimed is:

1. An umbrella assembly structured for use on a watercraft traveling at high speed, said umbrella assembly comprising:

a frame assembly including a support pole, a plurality of at least substantially linearly configured ribs, and a plurality of struts, each of said plurality of struts interconnected between said support pole and a correspondingly positioned one of said plurality of ribs, a canopy connected to and supported on said plurality of ribs, and a reinforcing assembly comprising at least one auxiliary strut connected to said frame assembly in supporting relation to a rib and a strut of at least one rib and strut pair, said at least one auxiliary strut comprising a first, proximal end connected to said strut at a location substantially adjacent said support pole, and a second, distal end connected to an outer, distal end of said rib, and said at least one auxiliary strut formed of a rigid material and being structured to restrict said canopy from collapsing in an upward and downward direction.

2. An umbrella assembly as recited in claim 1 further comprising a restraining assembly interconnected between a leading portion of said frame assembly and a supporting structure; said restraining assembly disposed and structured to retain said frame assembly in an operative position.

3. An umbrella assembly as recited in claim 2 wherein said restraining assembly comprises at least one restraining member interconnected between the supporting structure and said one rib and strut pair.

4. An umbrella assembly as recited in claim 1 wherein said support pole, a remainder of said frame assembly and said canopy are collectively structured to be removably mounted on a marine craft.

5. An umbrella assembly as recited in claim 1 wherein said canopy and at least a portion of said frame assembly are cooperatively structured to dispose and maintain said canopy in a substantially flat orientation when said canopy is in an operative position.

6. An umbrella assembly as recited in claim 1 further comprising an anchor assembly disposed and structured to secure predetermined portions of said canopy to predetermined portions of said frame.

7. An umbrella assembly as recited in claim 6 wherein said anchor assembly and said reinforcing assembly are commonly connected to said one rib and strut pair.

8. An umbrella assembly as recited in claim 7 wherein said at least one rib and strut pair at least partially define a substantially leading portion of said frame assembly.

9. An umbrella assembly as recited in claim 7 wherein said anchor assembly is disposed and structured to secure said canopy to a substantially intermediate portion of said one rib and strut pair.

10. An umbrella assembly as recited in claim 6 wherein said anchor assembly comprises at least one anchor member fixedly connected to said canopy.

11. An umbrella assembly as recited in claim 10 wherein said anchor member comprises an elongated configuration and is removably connected to said one rib and strut pair.

12. An umbrella assembly as recited in claim 11 wherein said anchor member comprises an elongated sleeve disposed in a substantially surrounding relation to said rib of said one rib and strut pair.

13. An umbrella assembly as recited in claim 12 wherein said elongated sleeve includes a connector assembly disposed on opposite longitudinal free sides thereof, said connector assembly extending along a length of said sleeve and structured to removably dispose said sleeve in said substantially surrounding relation to said rib of said one rib and strut pair.

14. An umbrella assembly in combination with a water craft, said watercraft comprising a deck, said combination comprising:

a base fixedly attached and secured to said deck of said watercraft, a frame assembly disposed in a removably secured relation with said base, wherein said frame assembly and said base are structured to maintain said removably secured relation with one another during strong wind conditions, said frame assembly comprising a support pole, a plurality of ribs, and a plurality of struts, each of said plurality of ribs comprising a substantially linear configuration, a canopy connected to and supported by at least some of said plurality of ribs, said canopy structured to assume a substantially flat orientation in profile when disposed in a position to provide shade to portions of the water craft, corresponding positioned ones of said plurality of ribs and said plurality of struts defining a plurality of rib and strut pairs, said rib and said strut of each of said plurality of rib and strut pairs being coupled to one another at a connection juncture disposed along a longitudinal portion of said rib and defining an outer longitudinal portion disposed between said connection juncture and an outer, distal end of said rib, a reinforcing assembly and an anchoring assembly disposed on each of said plurality of rib and strut pairs, each of said reinforcing assemblies comprising an auxiliary strut interconnected in supporting relation between a rib and a strut of said rib and strut pair, said auxiliary strut of each of said reinforcing assemblies comprising a first, proximal end connected to said strut at a location substantially adjacent said support pole, and a second, distal end connected to an outer, distal end of said rib, said at least one auxiliary strut being formed of a rigid material and structured and disposed to restrict said canopy from collapsing in an upward and downward direction, said anchor assembly comprising at least one elongated anchor member disposed and structured to secure predetermined portions of said canopy to predetermined portions of a rib of each of said plurality of rib and strut pairs, and said at least one elongated anchor member being disposed in a covering relation along a majority of said outer longitudinal portion of said rib.

* * * * *